US008926425B2

(12) United States Patent
Link et al.

(10) Patent No.: US 8,926,425 B2
(45) Date of Patent: Jan. 6, 2015

(54) SYSTEM AND METHOD FOR PROVIDING LOYALTY-BASED VIRTUAL OBJECTS ACROSS VARIOUS MEDIA INCLUDING GAMING DEVICES

(71) Applicant: Bally Gaming, Inc., Las Vegas, NV (US)

(72) Inventors: John Link, Manteca, CA (US); Kiran Brahmandam, Fremont, CA (US)

(73) Assignee: Bally Gaming, Inc., Las Vegas, NV (US)

( * ) Notice: Subject to any disclaimer, the term of this patent is extended or adjusted under 35 U.S.C. 154(b) by 92 days.

(21) Appl. No.: 13/855,356

(22) Filed: Apr. 2, 2013

(65) Prior Publication Data

US 2014/0080590 A1 Mar. 20, 2014

Related U.S. Application Data

(60) Provisional application No. 61/701,976, filed on Sep. 17, 2012.

(51) Int. Cl.
*A63F 9/24* (2006.01)

(52) U.S. Cl.
USPC ..... 463/25; 463/42; 446/175

(58) Field of Classification Search
USPC ..... 463/16–42; 446/175
See application file for complete search history.

(56) References Cited

U.S. PATENT DOCUMENTS

| | | | | |
|---|---|---|---|---|
| 5,639,088 | A | 6/1997 | Schneider et al. | |
| 5,655,961 | A | 8/1997 | Acres et al. | |
| 5,833,540 | A | 11/1998 | Miodunski et al. | |
| 6,217,448 | B1 | 4/2001 | Olsen | |
| 6,319,125 | B1 | 11/2001 | Acres | |
| RE37,885 | E | 10/2002 | Acres et al. | |
| 6,592,460 | B2 * | 7/2003 | Torango | 463/27 |
| 7,419,427 | B2 | 9/2008 | Boushy | |
| 7,582,014 | B2 * | 9/2009 | Olive | 463/25 |
| 8,167,713 | B2 | 5/2012 | Allen et al. | |
| 8,313,371 | B1 | 11/2012 | Luciano, Jr. | |
| 8,353,761 | B2 * | 1/2013 | Kelly et al. | 463/27 |
| 8,545,330 | B2 * | 10/2013 | Wickett et al. | 463/42 |
| 2007/0093299 | A1 * | 4/2007 | Bergeron et al. | 463/43 |
| 2011/0021260 | A1 | 1/2011 | Adiraju et al. | |
| 2011/0207525 | A1 * | 8/2011 | Allen et al. | 463/25 |
| 2012/0178525 | A1 | 7/2012 | Allen et al. | |
| 2013/0029760 | A1 * | 1/2013 | Wickett et al. | 463/29 |
| 2013/0281189 | A1 * | 10/2013 | Gagner et al. | 463/25 |

FOREIGN PATENT DOCUMENTS

| | | | |
|---|---|---|---|
| WO | WO 0032286 A1 | 6/2000 | |

* cited by examiner

*Primary Examiner* — Masud Ahmed
(74) *Attorney, Agent, or Firm* — Marvin Hein

(57) ABSTRACT

Gaming systems and methods are set forth designed to promote user loyalty with an enterprise. The user obtains a virtual object such as a virtual dog and earns the ability to acquire accessories or upgrades for their virtual dog through interaction with the enterprise. Certain accessories or upgrades may only be acquired or restored at a physical, brick and mortar venue for the enterprise to encourage the user to visit the venue. Acquisition of attributes such as accessories and upgrades may provide a basis for tournaments and prizes. The virtual object may be accessed and displayed at terminals at the venue or at remote devices. Acquisition of virtual objects may be used to qualify the user for a feature such as a progressive jackpot game.

20 Claims, 22 Drawing Sheets

FIG. 6
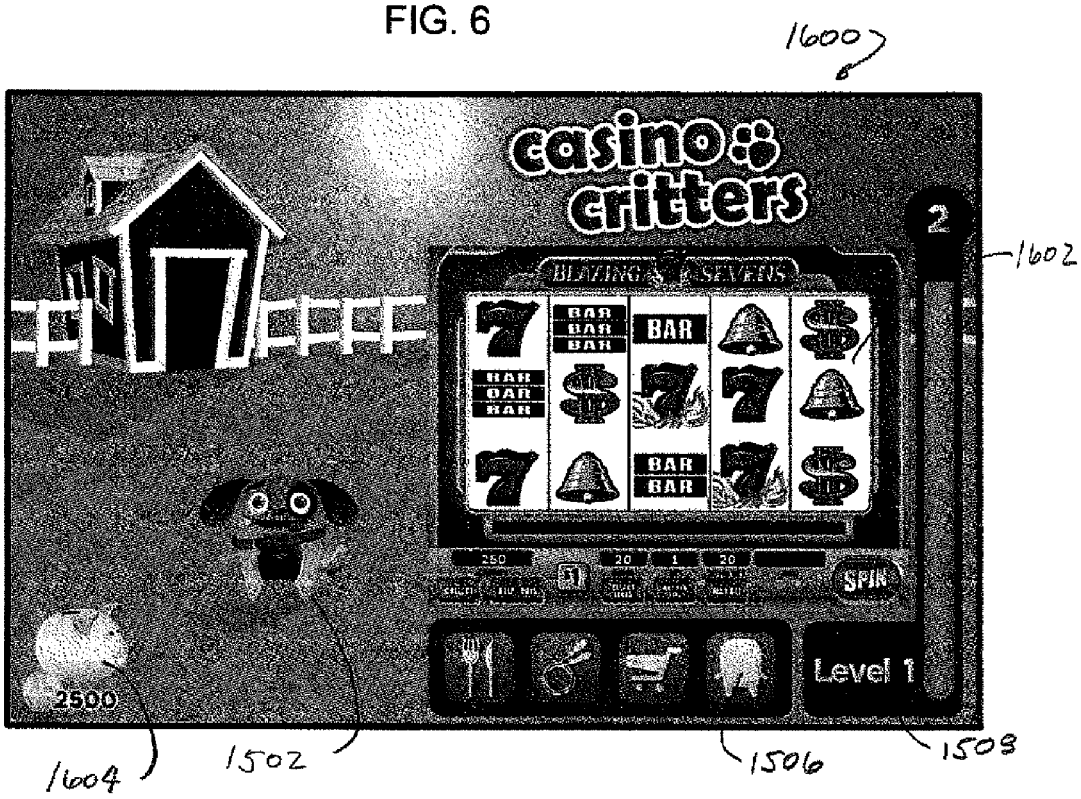
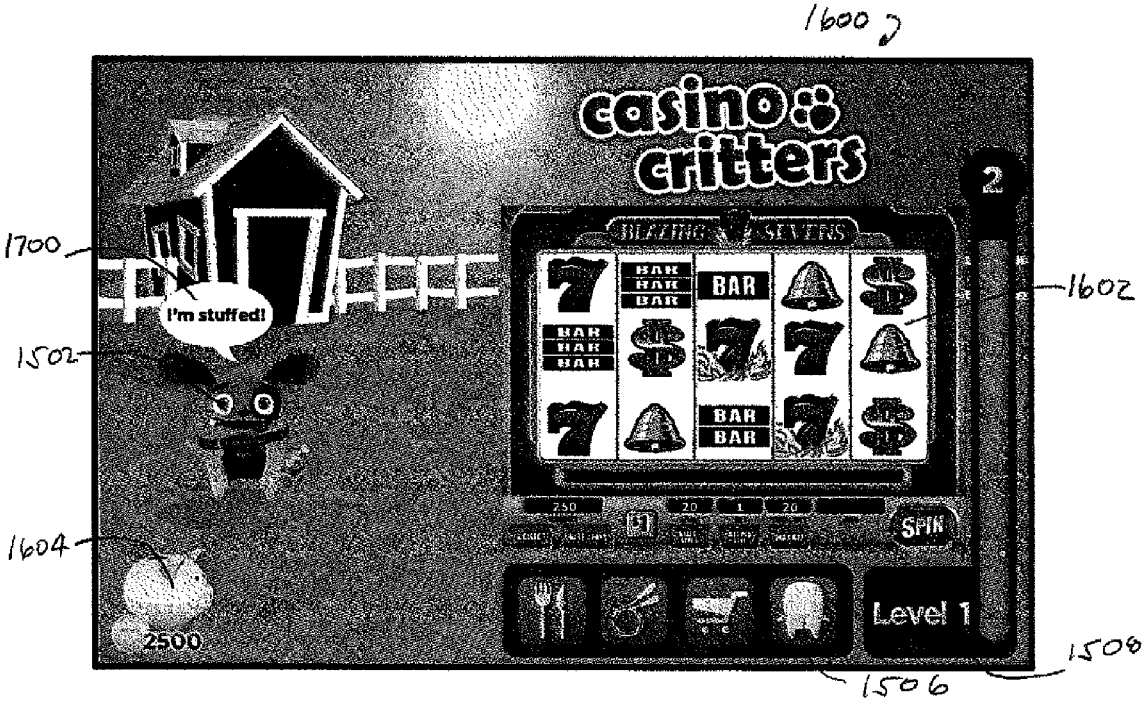
FIG. 7

SYSTEM AND METHOD FOR PROVIDING LOYALTY-BASED VIRTUAL OBJECTS ACROSS VARIOUS MEDIA INCLUDING GAMING DEVICES

CROSS REFERENCE TO RELATED APPLICATION

This application is a continuation-in-part of and claims priority to prior filed U.S. Provisional application Ser. No. 61/701,976 filed Sep. 17, 2012 and titled "A System and Method for Providing Loyalty-Based Virtual Objects Across Various Media Including Gaming Devices".

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The field of the invention relates to systems and method directed toward development of customer/user loyalty. More particularly it relates to systems and method which use configurable virtual objects and associable attributes to reflect and stimulate customer/user interaction with an enterprise such as a casino enterprise. In a further embodiment the acquisition of virtual objects are used to qualify the collector for benefits such as promotions and progressive jackpot games.

2. Background

Many enterprises, such as commercial enterprises including chain stores, grocery stores, airlines and casinos strive to engender loyalty and return business with their customers, users or players. It has been known to provide loyalty cards to customers who are, for grocery stores, often entitled to customer discounts. In exchange the store receives customer purchase information for the purpose of business intelligence, marketing and a degree of customer loyalty. Similarly in modern casino enterprises which may include several physical casino venues, players may enroll in the casino loyalty program. The casino enterprise includes a communication network by which an operator can monitor player activity such as wagers, jackpots, games played and the like. Players are identified typically through the player's use of a loyalty card having a machine readable stripe. For a brick and mortar casino an example of such a system is the Bally CMS® system sold by Bally Technologies, Inc. of Las Vegas, Nev. These systems interface with card readers at gaming terminals and table game input devices to provide the aforesaid tracking functions. Based upon the data collected the casino can provide bonuses to players in the way of benefits and incentives to retain a player's loyalty by, for example, awarding "comps" in the form of cash back, discounts for goods, lodging, services and gifts or points which can be exchanged for the foregoing. The tracking can be restricted to a single enterprise venue or can be on a national basis such as described in Boushy, U.S. Pat. No. 7,419,427 issued Sep. 2, 2008 and titled "National Customer Recognition System and Method", the disclosure of which is incorporated by reference. The level of "comps" available to the player is often related to the player's rating which acts to quantify the value of the player to the casino. A higher rated player is one who spends and gambles more than a lower rated player. A higher rated player is entitled to more valuable or additional comps.

Many casino enterprises also have a presence in electronic media such as by having commercial websites and social media sites accessible via the Internet or through broadband communication devices such as cellular telephones, smart phones, tablet computers and other devices.

There is an ever growing need to enhance the loyalty of customers/players in addition to offering such existing loyalty programs. There is a need to foster loyalty between players and the enterprise through activity associated with the "brick and mortar" casino venue as well as through associated electronic media. There is further a need to encourage a player or user to return to the brick and mortar physical venue inasmuch as the physical presence at the venue can often lead to the player or user spending money for entertainment, food and beverage, merchandise or other goods and services.

There is a need to provide entertainment in association with the objective of enhancing player loyalty. Entertainment may be by means of compelling graphics and animations, prizes and awards.

In electronic media such as the Internet and broadband communications, social networks have been developed such a Twitter, Facebook, etc. In this media-form it is known to provide "virtual pets". As understood, the user signs up for and selects/receives a virtual pet. The user is then required or requested to engage in activity through which the virtual pet may be nurtured or provided for. There are other virtual environments such as Farmville and the like.

It would be advantageous for an enterprise to use virtual objects to engender brand loyalty, encourage customer/user commercial and non-commercial activity, provide promotions, provide entertainment packages and provide the customer/user with an accessible virtual object. It would further be advantageous if such virtual objects could be used as a vehicle to encourage return visitation to the enterprise brick and mortar facility(ies). Further it would be advantageous to provide, in a brick and mortar or online casino environment, qualification to one or more progressive jackpot games responsive to the player's collection of one or more virtual objects.

It would be advantageous if the virtual object would have associable attributes such as accessories, fixtures, equipment, stock, upgrades or the like and which attributes are available based upon the user/player engaging in certain activity(ies) as desired by the enterprise.

It would also be advantageous to provide a data structure for storing data for derivation of virtual objects and a mechanism by which the enterprise could purchase data packages from developers to enhance the virtual objects and accessories available.

It has also been known to provide linked progressive jackpots to players playing games. Some examples include non-symbol based progressive jackpots such as described in Acres et al, U.S. Pat. No. Re. 37,885 titled "Method for operating Networked Linked Gaming Devices" re-issued Oct. 15, 2002 the disclosure of which is incorporated by reference. According to this reference, the operator preselects less than all of the machines on the network and the network tracks the activity of the presented machines. Players play the gaming machines. When a command is sent over the network a bonus is paid to at least one of the machines. Acres, et al U.S. Pat. No. 5,655,961 titled "Method for Operating Networked Linked Gaming Devices" issued Aug. 12, 1997, the disclosure of which is incorporated by reference teaches contributing a percentage of the amount wager at gaming machines to a bonus pool, i.e. a progressive jackpot pool. The triggering of the payment of money from the bonus pool can be an event such as when the bonus pool reaches a predetermined amount. Eligibility to win a mystery bonus award can be based upon time of play, max bet and/or recognition of a player's card at the machine as described in Olsen, U.S. Pat. No. 6,217,448 issued Apr. 17, 2001 and titled "Controller-based Linked Gaming Machine Bonus System", the disclosure of which is incorporated by reference. These bonus schemes are not tied to any symbols at the gaming machine and their triggering is a surprise or mystery to the player. Another type of mystery progressive jackpot has a trigger as described in Kelly et al, U.S. Pat. No. 8,353,761 titled "Progressive Game and Processing System Thereof" which is assigned to the assignee of the present invention and the disclosure of which is incorporated by reference.

Another type of non-symbol based progressive award is as described in Olive, U.S. Pat. No. 7,582,014 titled "Slot Machine Game and System With Improved Jackpot Feature" issued Sep. 1, 2009 and Torango, U.S. Pat. No. 6,592,460 titled "Progressive Wagering System" and issued Jul. 15, 2003 the disclosures of which is incorporated by reference. These disclosures describe another form of a progressive jackpot game where, with each play, the player is participating in a "behind the scenes" or "hidden" lottery. Based upon the amount of the wager for the primary (a/k/a base) game, the player can increase their odds of triggering a jackpot prize.

It has been taught that some progressive jackpot games have eligibility requirements such as wagering the maximum amount or wagering a certain amount over time to participate in the bonus pool. For example in Acres, U.S. Pat. No. 6,319,125 titled "Method Apparatus for Promoting Play on a Network of Gaming Devices" issued Nov. 20, 2001, the disclosure of which is incorporated by reference, to become eligible to participate a player must be identified as by their loyalty card and must play a game every ten seconds. In many such systems the eligibility is either determined by the player making a maximum wager, or wagering a minimum amount during a session of several plays, such as within a short temporal period of, for example, 20 seconds. Most typically eligibility does not persist over different gaming sessions or several days. By gaming session what is meant is the session where a player plays a gaming machine without significant interruption. Insertion and removal of the player's loyalty card may define a session as well as a significant interruption in play signifying that the player has discontinued gaming or left the casino.

Schneider et al U.S. Pat. No. 5,639,088 titled "Multiple Events Award System" issued Jun. 17, 1997 discloses a linked network of video poker games where the player, over several sessions, attempts to record over several rounds/sessions a set of outcomes such as all thirteen fours-of-a-kind.

In Luciano, Jr., U.S. Pat. No. 8,313,371 titled "Method and Apparatus for Awarding Component Prizes in a Gaming Environment" issued Nov. 201, 2012, assigned to the assignee of the present invention and the disclosure of which is incorporated by reference, there is a disclosed a game where, for certain outcomes, the player can win a virtual component of, for example, a tractor. When a player wins a virtual wheel in a paid for primary game outcome, that win results in a coupon or virtual record. When the player has won all of the designated tractor components, the player is entitled to the prize which may in fact be a lawn tractor.

Schneider and Luciano teach a persistent effect where the player can work toward a goal over several if not numerous gaming sessions and where the individual wins (a four-of-a-kind or a virtual tractor component) are saved for the player. A drawback is that the outcomes are outcomes for paid for primary games. That is, the player must risk wagers, as in a typical pay-to-play (P2P) game to obtain the desired outcomes. It would be advantageous to provide a feature which does not require the player to risk a wager and where the player can accumulate virtual items such as virtual objects and accessories, accoutrements, features of benefits with the user/player can interact such as a virtual pet or virtual environment like a virtual farm or city. It would also be advantageous to enable the player through earned or provided free games to be able to work, through acquiring virtual objects, to qualify for one or more features such as progressive prizes.

SUMMARY OF THE INVENTION

There is, therefore, provided in accordance with one aspect of the present invention improved systems and methods directed toward fostering user loyalty and encouraging repeat visits to a physical venue of an enterprise and providing marketing and advertising opportunities through various media and sources such as the Internet and broadband and commercial websites and social media sites. According to a further aspect of the present invention progressive prizes may be offered to users/players.

Toward this end and according to one aspect of the present invention, improved systems and methods are set forth for an enterprise of the type having at least one physical venue such as a brick and mortar business, resort or casino-resort. Located within the venue are terminals each of which has a video display. For example, a store may have cash-out terminals or user interactive kiosks. In a casino the terminals may be gaming devices/terminals, interfaces at live table games, kiosks and intra-property portable devices such as gaming tablets. A host server is configured for tracking a user's interaction with terminals. For example, in a store at check-out the cashier terminal or self-checkout terminal interfaces with the host to track use and other data such as items purchased. In a casino venue the host would track the player's gaming at gaming device such as slot machines, video lottery terminals and live table games. Information such as coin-in, jackpots, cash-outs, plays and the like are modernly tracked in casino enterprises. Other commercial activity or commerce such as the purchase of goods and services may be tracked as well. In other business enterprises, the user's purchases, site visits or other interactions, e.g. surveys, inquiries, etc. may be tracked. A communication network provides for communication between the terminals and the host server. A data structure stores a data file for each player/user. The data file may be anonymous and accessible by the anonymous user/player through a personal identification number (PIN) or biometric identifier. The data file may also be for an identified user/player that has enrolled and provided at least identification information. Identifiers such as a PIN or a loyalty card may be used to identify the user/player. The data file may include personal biographical information, electronic funds, promotional credits, loyalty points or the like. In one aspect of the present invention an improvement is provided which includes a data resource storing data corresponding to one or more graphical virtual objects and graphic display packages associated with said object: one or more of the data resource and user's file storing data associating a virtual object with a user. As but some examples, the virtual objects may be virtual pets such as a dog, cat, parrot, bear or monkey, virtual gems, gold nuggets, virtual race car, virtual rock band, virtual sports team, etc., or perhaps a person such as a fisherman or scuba diver or a virtual environment such as a farm, ranch, home or virtual business. In an embodiment the virtual objects have a plurality of virtual attributes or accoutrements associable with the virtual object(s). The attributes/accoutrements may be related to the virtual object's condition such, for a virtual pet attributes of hunger, thirst, fatigue, energy, happiness, sadness or accessories/accoutrements such as clothing, toys, collars, leashes, treats, houses, equipment, stock, tools, or upgrades. For a virtual environment the attributes may be crops, livestock, inventory, buildings, equipment or the like, as but an example. Devices enable a user to remotely access the data in their associated file via a remote interface device such as a computer, laptop or cellular device to view renditions of their virtual object data at said remote interface device display. One or more of the host and a feature server are configured to store data representing virtual currency awarded to the user and to enable the user to redeem virtual currency to alter the data corresponding to the user's virtual object by at least one acquisition of a virtual object, acquisition an attribute assigned to a virtual object and acquisition a virtual accessory for a virtual object.

As but an example, where a player at a casino has obtained a virtual pet dog and has earned virtual currency though intercourse with the casino to purchase a virtual collar and leash, the virtual currency is redeemed to purchase the virtual pet collar and leash which are then are associated with the player's data file. When the player inserts their player card at a gaming machine, graphics software displays the virtual pet dog with its collar and leash to the player and perhaps an endearing animation.

Apparatus is provided to enable a user/player to remotely access the data in their associated file to access their virtual object and current attributes at a remote device display, i.e. remote from the physical brick and mortar business. The remote device may be a home computer, tablet computer, cellular telephone, smart phone or the like. Providing remote access enables the user/player to view and/or interact with their virtual object outside of the enterprise physical venue.

One or both of the feature server and host server are configured to display the virtual object and current attributes at a user/display terminal display at the physical venue. For example, when a player goes to the casino enterprise physical casino property and interacts with a gaming device, their virtual object with its current attributes may be displayed to the player periodically, on player request, at player cash-out or continually. As but an example where the virtual object is a virtual pet dog, the virtual dog may be displayed at a location on a gaming device display or associated display and may interact to a degree with the player such as by celebrating jackpots, barking to draw the player's attention to a message, communicating with the player or the like to instill a "bonding" between the player and his/her virtual pet.

One or more of the host and feature server are configured to store virtual currency awarded to the user/player. The virtual currency may be awarded for commercial activity such as purchases, gaming or may be awarded by the enterprise as a "comp" reward for past commercial activity or to incentivize future business. For example, in a casino enterprise venue, when a player identified by the host server plays a gaming device, virtual currency would be awarded based upon wagering activity or in exchange for comp points awarded to the player. Virtual currency could be awarded for other consideration such as hotel visits, spa or restaurant purchases, and visits to the enterprise's website or social media site, completing a survey or the like.

The feature server is configured to enable the user/player to redeem virtual currency to restore or acquire attributes/accoutrements for their virtual object. To encourage the user/player to visit the enterprise physical venue virtual currency may be of several types or classes and have different purchasing power or attributes. For example, virtual currency earned by P2P (pay-to-play) gaming may be designated as first class virtual currency whereas those awarded by the casino for other activity may be designated as second virtual currency. Certain attributes/accoutrements may only be available for acquisition redeeming first class virtual currency. For example, where the virtual object is a virtual pet, attributes such as happiness or satisfaction of hunger or thirst may only be able to be acquired or restored through redemption of first class virtual currency whereas certain other attributes may be acquired/restored using second class virtual currency. Alternatively, there is a single class of virtual currency but some attributes/accoutrements may only be acquired or restored through redemption of virtual currency at a terminal at the physical brick and mortar casino. For example, attributes such as happiness or satisfaction of hunger or thirst may only be able to be acquired through redemption at the physical casino venue.

In an embodiment the user/player is able to download an application to their remote device to enable them to interact with their virtual object or otherwise remotely interact with their virtual object such as live streaming. The enterprise may offer attributes for acquisition, e.g. an accessory store for virtual pets. The user/player may redeem virtual currency to acquire attributes for their object such as purchasing a new collar for their virtual pet. The user/player may also interact with their virtual pet assisted by animation sequences. The feature server and/or cloud server or other source provides executable code to enable the interaction. For example, a user/player may use a touch screen on their smart phone to touch their virtual pet and executable code streamed or resident in the downloaded application provides animation to simulate scratching or tickling of the pet.

In an embodiment a secondary game and/or promotion may be conducted based upon the users/players acquisition of objects and/or accessories. As but an example, the virtual object may be a virtual pet store and the promotion and/or secondary game revolves around the users/players earning virtual currency to purchase pets for the store. The first user(s)/player(s) to complete their store and acquire all of the pets for sale win a prize or are entered into a promotion.

An advantage of the foregoing to the enterprise is that the acquisition of and interaction with the object drives loyalty between the user/player and the enterprise. When the player is not at the venue and is remotely interacting with the object, the user/player associates the object with the enterprise. Advertising, offers and promotions can be sent to the users/players in association with their object. The system graphics may alter the object over time to entice the user/player to visit the enterprise to restore the vitality to their object. The enterprise may also give incentives such as virtual cash to market to the users/players and enable them to acquire attributes/accoutrements fort their object.

Where the enterprise is a casino, many casinos provide "comp" points to players related to their wagering activity. These points are used in exchange for dining, entertainment and in some casinos can be exchanged for cash. As such awarded comp points represent a liability to the casino. It would be beneficial if the casino could retire comp points not only through tradition exchange for meals, services, cash but also to exchange for virtual objects, accessories or accoutrements of the type described above. For example, a player having comp points could remotely exchange them through their interaction with their virtual object on their cellular phone to purchase, for example, accessories for their pet.

In another aspect of the present invention the acquisition of virtual objects, accessories or accoutrements may provide a basis for a player to become eligible for certain features or benefits. As but an example where the enterprise is a casino, players may be entitled to participate in promotions and/or progressive jackpot games after they have acquired one or more virtual objects. As an illustrative example, and not be way of limitation, the feature server including executable code is in communication with one or more of the data resource and the player's file. While at the casino enterprise venue, i.e. brick and mortar casino, the player's commerce with the casino such as wagering on slot machines, or table games or purchasing goods or services, entitles the player to free plays of a secondary game. Where the player is playing a slot machine, periodically or routinely, a free-play secondary slot machine game is displayed to the player for example at a secondary display or at a picture-in-picture display at the main game display. The secondary game provides winning and losing outcomes. For a winning outcome the player is awarded a virtual object such as a virtual dog. The secondary slot machine game may have symbols corresponding to the virtual dog and other virtual animals such as a parrot, monkey, bear, cat or the like. Free secondary games may be awarded for play of a P2P game, as promotions or even in exchange for casino provided comp points. The object of the secondary game is for the player to acquire the complete set of virtual animals. This may take a single gaming session or gaming sessions over several days, weeks or months. As the items of the virtual set are acquired the player's file is appropriately updated. Once the player has acquired the required set the player is then qualified for a feature such as a progressive jackpot game or a system derived progressive applied to the P2P base slot machine game they are playing or their table game. Once qualification is established contributions from the wagers to play the primary slot machine game (or table game) are made to the progressive. The progressive may also be funded with marketing dollars alone or in combination with P2P coin in contribution. When a progressive jackpot win is triggered all or a portion of the prize is provided to the winning player(s). The trigger may be based upon the jackpot pool reaching a determined amount or other event such as coin in (the cumulative amount bet on P2P games on the progressive network), coin out (the cumulative amount paid out to players on P2P games on the progressive network) or running, in the background and at the system level, a lottery or draw conducted at selected time increments or with each wager or a modified, quasi lottery or draw where the lottery/draw is conducted at time slices, e.g. every few seconds, and where the pool of lottery numbers is reduced with each drawing until the trigger number, e.g. "1" is selected. Once the award is triggered the winner may be randomly selected from the participating gaming machines. Other triggers could be used as well.

The player may earn free secondary games remotely or even virtual animals to complete their set. For example, in social media, if a user/player "invites" ten friends to sign up for the promotion they may be awarded a virtual animal. Virtual animals toward qualification may also be earned through commerce with the enterprise such as booking a stay, responding to a promotion, the purchase of merchandise, "liking" the enterprise in social media or the like. Where permitted the player may remotely earn and/or play secondary games, the primary game and participate in the progressive.

In an embodiment user/players may trade, auction or sell a virtual object or accessory/accoutrement to another user/player. The establishment in this regard may host a virtual trading or auction house for such purposes and take a fee for any or some transactions.

In an embodiment certain virtual objects are rarely offered to entice users/players to attempt to acquire those objects when offered. As a non-limiting example, a virtual bear may only be available to be won or acquired on Fridays between 9 am and 9 pm.

Various progressives can be established for players of different rating (relative worth to the enterprise) and the player once qualified may be qualified to participate in numerous progressives.

Other features and numerous advantages of the various embodiments will become apparent from the following detailed description when viewed in conjunction with the corresponding drawings.

BRIEF DESCRIPTION OF THE DRAWINGS

FIGS. 6 and 7 illustrate displays of a virtual object embodied as a virtual pet dog and a slot machine game;

DETAILED DESCRIPTION

While the present invention is primarily described with reference to a casino enterprise, it should be understood that the present invention and its various embodiments could be extended to other enterprises such as stores, service providers or other businesses which deal with repeat business customers and which desire to foster customer loyalty and entice the customers to return to their brick and mortar venues. In lieu of gaming devices a commercial enterprise would instead have transaction terminals (or interactive sites on the Internet or through broadband communication networks) which track commercial activities, store customer data and provide the features and improvements as hereinafter described.

Gaming Enterprise Environment

Figure 1:
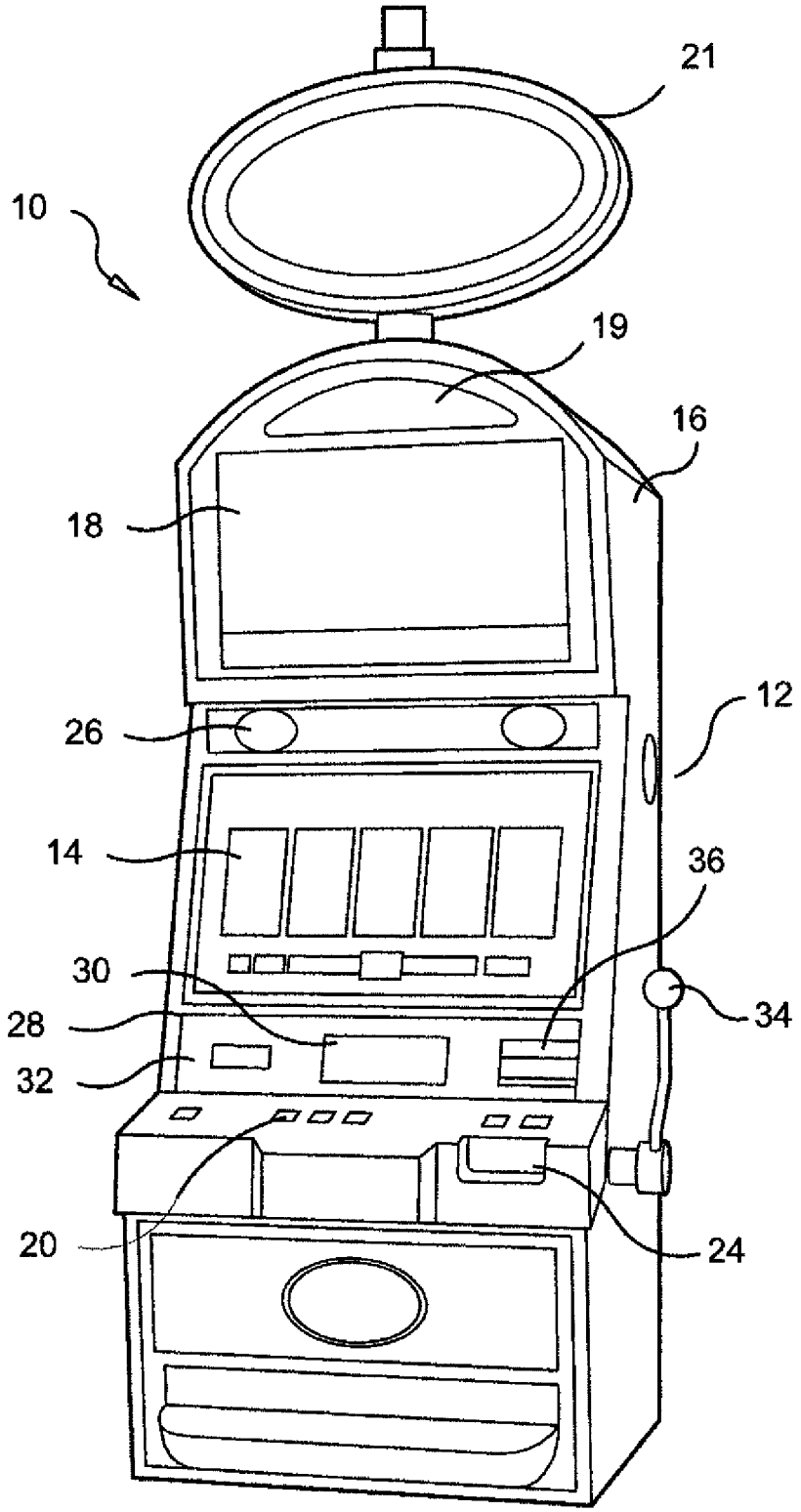
FIG. 1 illustrates a gaming terminal.

Referring now to the drawings, wherein like reference numbers denote like or corresponding elements throughout the drawings, and more particularly referring to FIG. 1, a gaming device 10 according to one or more embodiments of the present invention is shown. The gaming device 10 includes a cabinet 12 providing an enclosure for the several components of the gaming device 10 and associated equipment. A primary game display 14 is mounted to the cabinet 12. The primary game display 14 may be a video display such as an LCD, plasma, OLED or other electronic display or it may be an electro-mechanical display such as electro-mechanical stepper reels as are known in the art. The primary game display 14 may also be embodied as a combination of two or more electronic or mechanical displays disposed in an adjacent overlapping or overlying arrangement. The primary game display 14 may be mounted to one or more of a door for the cabinet 12 or the cabinet chassis itself. The primary game display 14 is located to display game content (and if desired other content) to the player. For example, the game content may be game outcomes presented by a plurality of video or electro-mechanical reels displaying symbols the combinations of which define winning or losing outcomes, video Poker, Keno or other form of base casino wagering game as is known in the art. Where the primary game display 14 is a video display, features such as bonus/feature games may also be presented. The foregoing description should not be deemed as limiting the content (graphics, video or text) which can be displayed at the primary game display 14. The cabinet 12 may comprise a slant-top, bar-top, or table-top style cabinet as is known in the art.

The gaming device 10 also includes in one or more embodiments a top box 16 which may support a printed back-lit glass (not shown) as is known in the art depicting the rules, award schedule, attract graphics or it may support a secondary game display 18 which may be of one of the types described above with reference to the primary game display 14. The top box 16 may also support a backlit glass with graphics defining a marquee 19 and a topper 21 including additional graphics.

To enable a player to provide input to the controller for the gaming device 10 a plurality of buttons 20 may be provided on a button deck for the gaming device 10. Additionally and alternatively one or both of the primary and secondary game displays 14, 18 may include touch screen input devices as are known in the art. Buttons, selections or inputs are displayed at the primary and secondary game displays 14, 18 and the player touching those icons or designated areas provides the required or desired input to configure and play the gaming device 10.

Other peripherals or associated equipment for the gaming device 10 include a bill/voucher acceptor 24 which reads and validates currency and vouchers for the player to establish credits for gaming on the gaming device 10 and one or more speakers 26 to provide audio content to the player in association with the game play. To provide for communication between the gaming device 10 and a casino system, a player tracking module (PTM) 28 is mounted on the cabinet 12. PTM 28 has a PTM display 30 to display system related information to the player. The PTM display 30 may be a small LCD, plasma or OLED display with touch screen functionality. In an embodiment the virtual objects and accessories/accoutrements described herein are displayed at the PTM display 30; however, as set forth below these presentations can be migrated to the primary or secondary displays 14, 18. A card reader 32 is provided to read a machine readable component on a player loyalty card (not shown) issued to the player to identify the player to the casino system as in known in the art. A ticket printer 36 may be provided as well on the PTM 28 or elsewhere on the gaming device 10 to provide printed value ticket vouchers to players when they cash out as is also known in the art.

The display and functionality of the PTM 28 may be migrated to the primary display 18 as is disclosed in Kelly et al, U.S. Pat. No. 8,241,123 titled "Video Switcher and Touch Router Method for a Gaming Machine" issued Aug. 14, 2012 and Kelly et al U.S. Pat. No. 8,241,124 titled "Gaming Machine Having a Curved Display With a Video Switcher and Touch Router System", issued Aug. 14, 2012 the disclosures of which are hereby incorporated. According to these disclosures system and externally based content including the virtual objects and mystery game presentations as hereinafter described may be displayed at one or more of the primary or secondary displays 14, 18 dispensing with the need for the PTM display 30. Accordingly it should be understood that the virtual objects and accessories described herein could be displayed at regions at one or more of the primary or secondary displays 14, 18.

While the player may use the buttons 20 to prompt play of the game (or the touch screen input), alternatively the player may use a handle 34 to prompt an input as is known in the art.

Cabinet 12 may be a self-standing unit that is generally rectangular in shape and may be manufactured with reinforced steel or other rigid materials which are resistant to tampering and vandalism. Any shaped cabinet may be implemented with any embodiment of gaming device 10 so long as it provides access to a player for playing a game. For example, cabinet 12 may comprise a slant-top, bar-top, or table-top style cabinet, including a Bally Cinevision™ or CineReels™ cabinet. The gaming device 10 may include a controller and memory disposed within the cabinet 12 or may have thin client capability such as that some of the computing capability is maintained at a remote server.

The plurality of player-activated buttons 22 may be used for various functions such as, but not limited to, selecting a wager denomination, selecting a game to be played, selecting a wager amount per game, initiating a game, or cashing out money from gaming machine 10. Buttons 22 may be operable as input mechanisms and may include mechanical buttons, electromechanical buttons or touch screen buttons. In one or more embodiments, buttons 22 may be replaced with various other input mechanisms known in the art such as, but not limited to, touch screens, touch pad, track ball, mouse, switches, toggle switches, or other input means used to accept player input. For example, one input means is as disclosed in U.S. Pub. App. 2011/0111853, entitled "Universal Button Module," filed on Jan. 14, 2011 and/or U.S. Pub. App. 2010/0113140 entitled "Gesture Enhanced Input Device" filed Nov. 16, 2009 which are hereby incorporated by reference. Player input may also be by providing touch screen functionality at the primary game display 14 and/or secondary game display 18.

The primary game display 14 may present a primary game of chance wherein, for a wager, a player receives one or more outcomes from a set of potential outcomes. For example, one such game of chance is a video slot machine game. In other aspects of the invention, gaming machine 10 may present a video or mechanical reel slot machine, a video keno game, a lottery game, a bingo game, a Class II bingo game, a roulette game, a craps game, a blackjack game, a mechanical or video representation of a wheel game or the like. In a casino environment the base game is most often a pay-to-play (P2P) game meaning that the player must stake a wager to receive either a winning or losing outcome.

While gaming devices 10 as described above at used at brick and mortar casino venues, various aspects of the present invention may also be applied to remote gaming such as Internet and mobile gaming (whether P2P gaming or free, promotional gaming) as well as gaming in or about the casino venue using approved mobile devices such as tablets and the like.

Figure 2A:
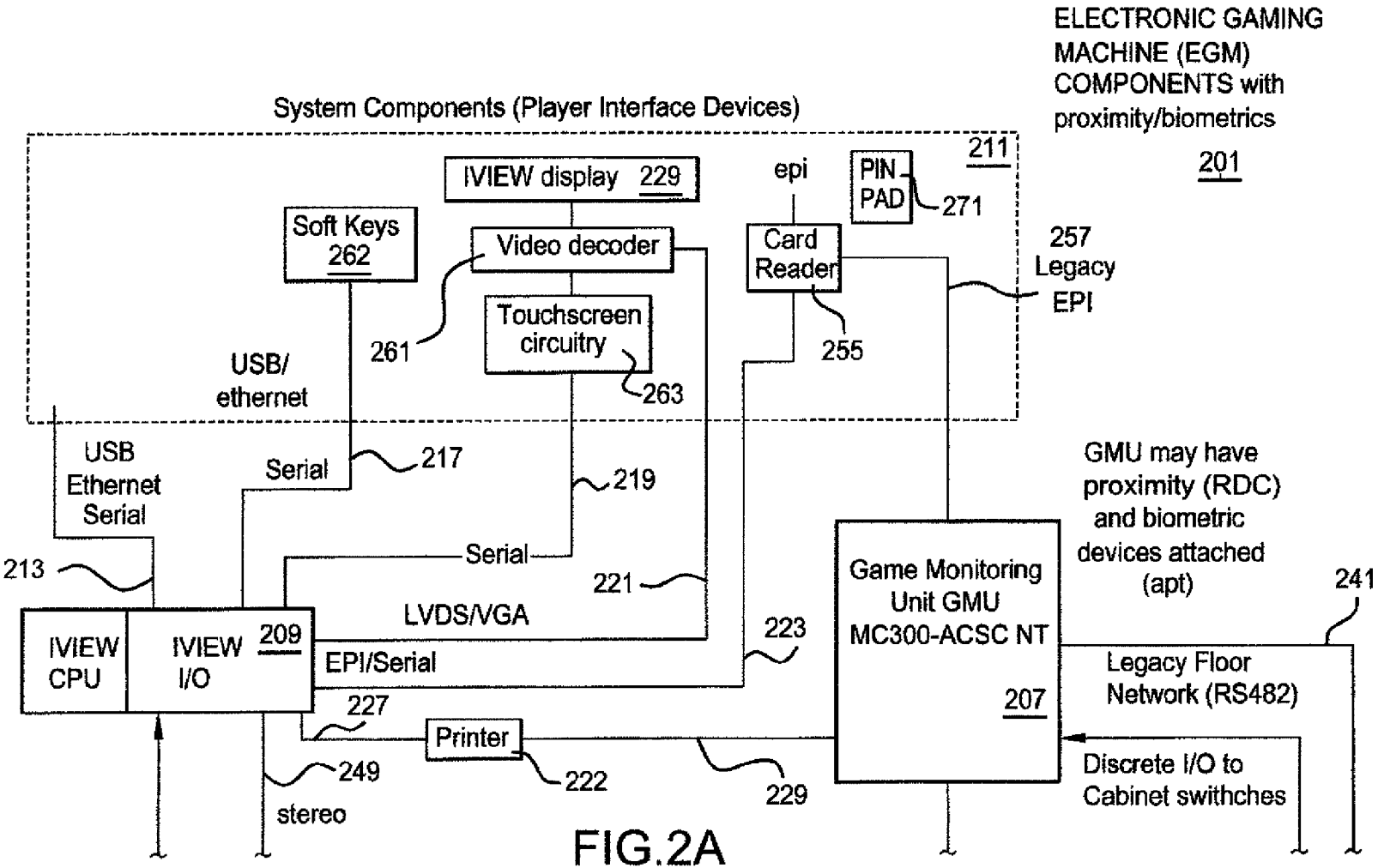
FIGS. 2A-B illustrate an example of a gaming terminal operational platform and components for a gaming terminal of the type of the present invention.
Figure 2B:
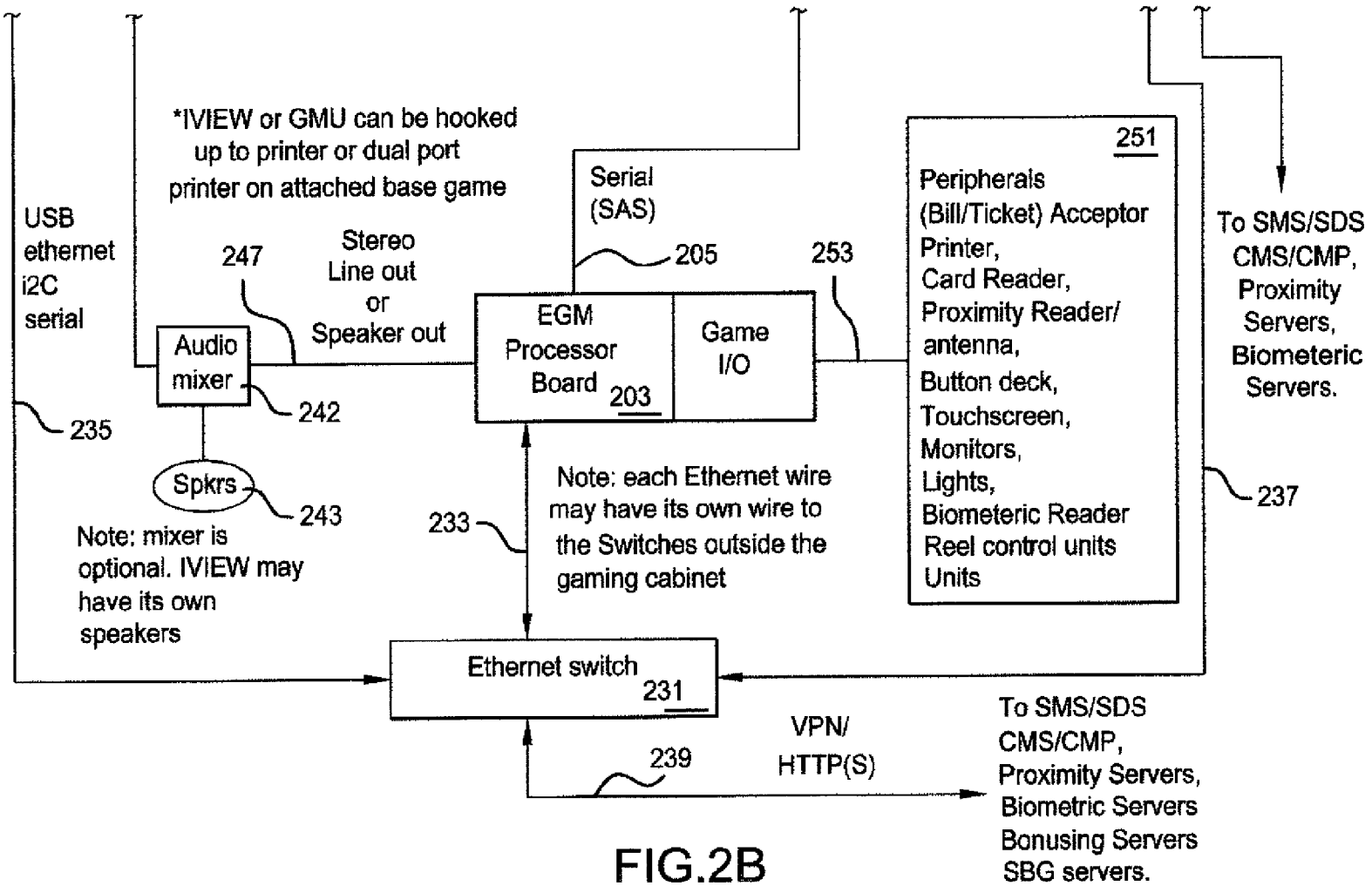

Referring to FIGS. 2A, B, the gaming device 10 hardware 201 for the controller(s) is shown in accordance with one or more embodiments. The hardware 201 includes base game processor board 203 (EGM Processor Board) connected through serial bus line 205 to game monitoring unit (GMU) 207 (such as a Bally MC300 or ACSC NT manufactured and sold by Bally Gaming, Inc., Las Vegas, Nev.). EGM Processor Board 203 is connected to the PID 209 over bus line 249 and PID 209 is connected to the iView device such as 211 in FIG. 2A through bus lines 213, 217, 219, 221, 223. The PID 209 provides for communication between one or more gaming devices 10 and the casino system such as the type as hereinafter described. Inasmuch as gaming devices 10 may be manufactured by different entities, mounting like PTMs 28, 211 and PIDs 209 at each gaming device 10 provides for communication to the system in one or more common message protocols. Typically when a casino enterprise purchases a casino management system they also purchase the same manufacturer's PTMs 28, 211 and PIDs 209 which are then installed by the various manufacturers of the gaming devices 10 for the enterprise before delivery. In this manner the mountings for the PTMs 28, 211 on the gaming devices can be configured for location and esthetic appearance. Gaming voucher ticket printer 36 (for printing player cash out tickets) (shown as 222 in FIG. 2A) is connected to PID 209 and GMU 207 over bus lines 227, 229. EGM Processor Board 203, PID 209 and GMU 207 connect to Ethernet switch 231 over bus lines 233, 235, 237. Ethernet switch 231 connects to a slot management system and a casino management system (SMS, SDS, CMS and CMP) (FIGS. 4A, 4B) network over bus line 239. Ethernet switch 231 may also connect to a server based gaming server or a downloadable gaming server. GMU 207 also may connect to the network over bus line 241. Speakers 26 (shown as 243 in FIG. 2B) to produce sounds related to the game or according to the present invention connect through audio mixer 242 and bus lines 247, 249 to EGM Processor Board 203 and PID 209.

Peripherals 251 connect through bus 253 to EGM Processor Board 203. The peripherals 251 include, but are not limited to the following and may include individual processing capability: bill/voucher acceptor 24 to validate and accept currency and ticket vouchers, the player interfaces such a buttons 20, primary and secondary game displays 14, 18 and any secondary or tertiary displays (with/without) touch screen functionality, monitors and lights. The peripherals 251 may include the displays as hereinafter described with reference to the various embodiments of the present invention as herein described or their equivalents. For example, the bill/voucher acceptor 24 is typically connected to the game input-output board of the EGM processing board 203 (which is, in turn, connected to a conventional central processing unit ("CPU") board), such as an Intel Pentium® microprocessor mounted on a gaming motherboard. The I/O board may be connected to CPU processor board 203 by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS. EGM processor board 203 executes a game program that causes the gaming device 10 to display and play a game. The various components and included devices may be installed with conventionally and/or commercially available components, devices, and circuitry into a conventional and/or commercially available gaming terminal cabinet 12.

When a player has inserted a form of currency such as, for example and without limitation, paper currency, coins or tokens, cashless tickets or vouchers, electronic funds transfers or the like into the currency acceptor, a signal is sent by way of bus 253 to the I/O board and to EGM processor board 203 which, in turn, assigns an appropriate number of credits for play in accordance with the game program. The player may further control the operation of the gaming machine by way of other peripherals 251, for example, to select the amount to wager via the buttons 20. The game starts in response to the player operating a start mechanism such as the handle 34, button 20 such as a SPIN/RESET button or a touch screen icon. The game program includes a random number generator to provide a display of randomly selected indicia on one or more displays such as the primary game display 14 as shown in FIG. 1. In some embodiments, the random generator may be physically separate from gaming device 10; for example, it may be part of a central determination host system which provides random game outcomes to the game program. Finally, EGM processor board 203 under control of the game program and OS compares the outcome to an award schedule. The set of possible game outcomes may include a subset of outcomes related to the triggering and play of a feature or bonus game. In the event the displayed outcome is a member of this subset, EGM processor board 203, under control of the game program and by way of I/O Board, may cause feature/bonus game play to be presented on the primary game display 14 and/or any secondary display(s) 18.

Predetermined payout amounts for certain outcomes, including feature game outcomes, are stored as part of the game program. Such payout amounts are, in response to instructions from EGM processor board 203, provided to the player in the form of coins, credits or currency via I/O board and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In an embodiment, the remote storage device is housed in a remote server such as a downloadable gaming server. The gaming machine may access the remote storage device via a network connection, including but not limited to, a local area network connection, a TCP/IP connection, a wireless connection, or any other means for operatively networking components together. Optionally, other data including graphics, sound files and other media data for use with the gaming terminal are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the gaming terminal using USB, serial or Ethernet connections. Each of the respective devices may have upgrades to their firmware utilizing these connections.

GMU 207 includes an integrated circuit board and GMU processor and memory including coding for network communications, such as the G2S (game-to-system) protocol from the Gaming Standards Association, Las Vegas, Nev., used for system communications over the network. As shown, GMU 207 may connect to the card reader 32 (shown as 255 in FIG. 2A) through bus 257 and may thereby obtain player information and transmit the information over the network through bus 241. Gaming activity information may be transferred by the EGM Processor Board 203 to GMU 207 where the information may be translated into a network protocol, such as S2S, for transmission to a server, such as a player tracking server, where information about a player's playing activity may be stored in a designated server database.

PID 209 includes an integrated circuit board, PID processor (iView CPU), and memory which includes an operating system, such as Windows CE, a player interface program which may be executable by the PID 209 processor together with various input/output (I/O) drivers for respective devices which connect to PID processor and which may further include various games or game components playable on PTM 28, 211 or playable on a connected network server and PTM 28, 211 is operable as the player interface. PID 209 connects to card reader 32 (shown as 255 in FIG. 2A) through bus 223, player tracking display 30 (shown as iView display 229 in FIG. 2A) through video decoder 261 and bus 221, such as an LVDS or VGA bus.

As part of its programming, the PID 209 processor executes coding to drive player tracking display 30, 229 and provide messages and information to a player. Touch screen circuitry 263 interactively connects PTM display 30, 229 and video decoder 261 to PTM 28, 211 such that a player may input information and causes the information to be transmitted either on the player's initiative or responsive to a query. Additionally soft keys 262 connect through bus 217 to PID 209 and operate together with the player tracking display 30 to provide information or queries to a player and receive responses or queries from the player. PID 209, in turn, communicates over the CMS/SMS network through Ethernet switch 231 and busses 235, 239 and with respective servers, such as a player tracking server.

PTMs 28 are linked into the virtual private network of the system components in gaming terminal 10. The system components include the player tacking module 28 (e.g. Bally iVIEW® device) ('iView" is a registered trademark of Bally Gaming, Inc.), PID 209, EGM processing board 203 and game monitoring unit (GMU) processing board 207. These system components may connect over a network to the slot management system (such as a commercially available Bally SDS/SMS) and/or casino management system (such as a commercially available Bally CMP/CMS).

The GMU 207 system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to installation on the system components.

The system components include the PTM 28 processing board (PID 209) and game monitoring unit (GMU) 207. The GMU 207, PID 209 and PTM 28 can be combined into one like the commercially available Bally GTM iVIEW device. This device may have a video mixing technology to mix the EGM processor's video signals with the iVIEW display onto the top box monitor or any monitor on the gaming device.

The PTM 28 may also interface with a switcher and router device of the type described above. In such case, instead of providing the PTM display 30, the switcher and router device provides for the content normally display at the PTM display 30 to be displayed at one or more of the primary or secondary displays 14, 18.

Figure 3:
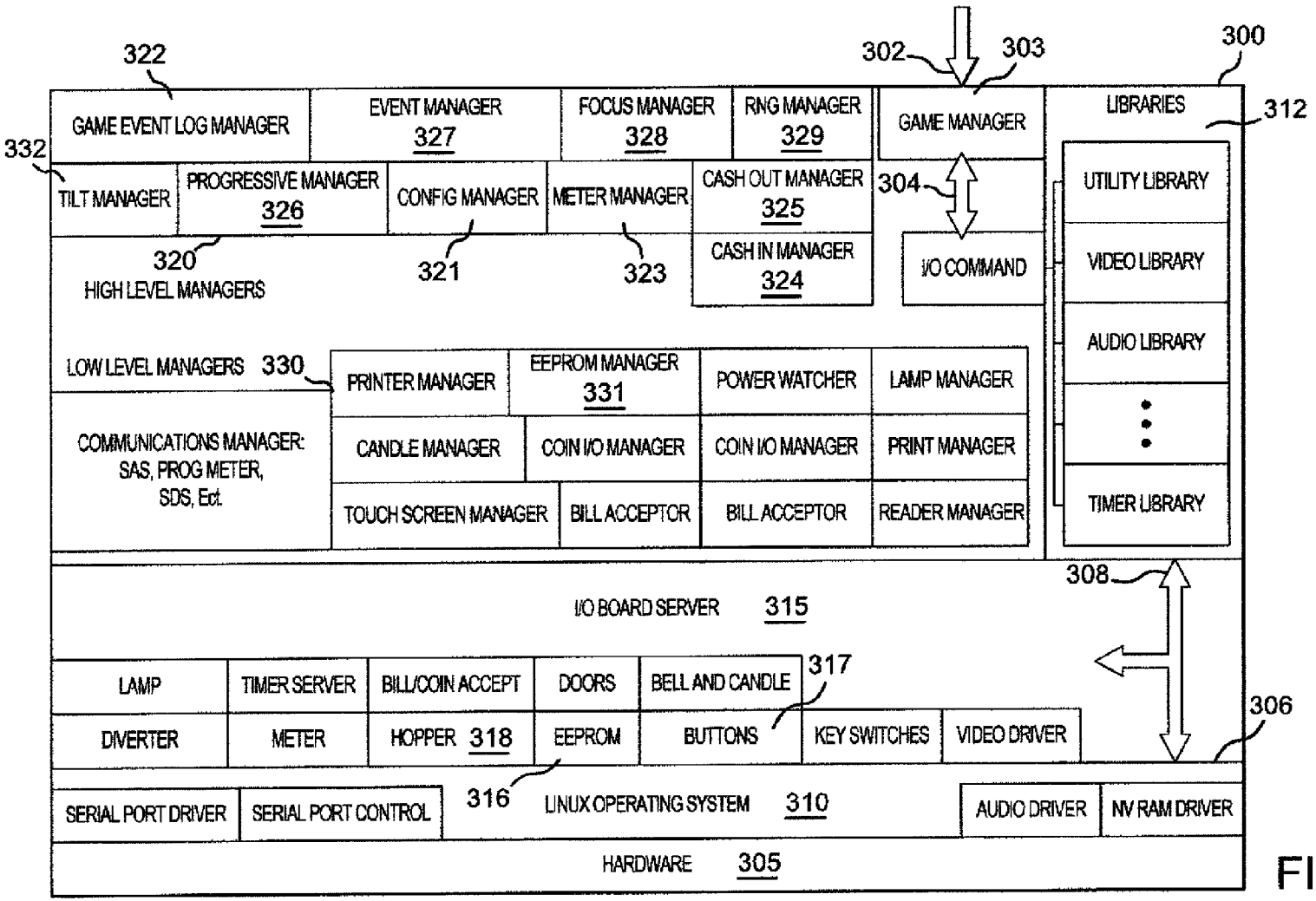
FIG. 3 is a block diagram of the logical components of a gaming kernel for a gaming terminal.

In accordance with one or more embodiments, FIG. 3 is a functional block diagram of a gaming kernel 300 of a game program under control of gaming device EGM processor board 203. The game program uses gaming kernel 300 by calling into application programming interface (API) 302, which is part of game manager 304. The components of game kernel 300 as shown in FIG. 3 are only illustrative, and should not be considered limiting. For example, the number of managers may be changed, additional managers may be added or some managers may be removed without deviating from the scope and spirit of the invention.

As shown in the example, there are three layers: a hardware layer 306; an operating system layer 308, such as, but not limited to, Linux; and a game kernel layer having game manager 304 therein. In one or more embodiments, the use of an operating system layer 310, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel 300 executes at the user level of the operating system layer 308, and itself contains a major component called the I/O board server 315. To properly set the bounds of game application software (making integrity checking easier), all game applications interact with gaming kernel 300 using a single API 302 in game manager 304. This enables game applications to make use of a well-defined, consistent interface, as well as making access points to gaming kernel 300 controlled, where overall access is controlled using separate processes.

For example, game manager 304 parses an incoming command stream and, when a command dealing with I/O comes in (arrow 312), the command is sent to an applicable library routine 314. Library routine 314 decides what it needs from a device, and sends commands to I/O board server 310 (see arrow 308). A few specific drivers remain in operating system layer 310's kernel, shown as those below line 306. These are built-in, primitive, or privileged drivers that are (i) general (ii) kept to a minimum and (iii) are easier to leave than extract. In such cases, the low-level communications is handled within operating system layer 310 and the contents passed to library routines 314.

Thus, in a few cases library routines may interact with drivers inside operating system layer 310, which is why arrow 308 is shown as having three directions (between library routines 314 and I/O board server 315, or between library routines 314 and certain drivers in operating system layer 306). No matter which path is taken, the logic needed to work with each device is coded into modules in the user layer of the diagram. Operating board server layer 306 is kept as simple, stripped down, and common across as many hardware platforms as possible. The library utilities and user-level drivers change as dictated by the game cabinet or game machine in which it will run. Thus, each game cabinet or game machine may have an industry standard EGM EGM processing board 203 connected to a unique, relatively dumb, and as inexpensive as possible I/O adapter board, plus a gaming kernel 300 which will have the game-machine-unique library routines and I/O board server 315 components needed to enable game applications to interact with the gaming machine cabinet. Note that these differences are invisible to the game application software with the exception of certain functional differences (i.e., if a gaming cabinet has stereo sound, the game application will be able make use of API 302 to use the capability over that of a cabinet having traditional monaural sound).

Game manager 304 provides an interface into game kernel 300, providing consistent, predictable, and backwards compatible calling methods, syntax, and capabilities by way of game application API 302. This enables the game developer to be free of dealing directly with the hardware, including the freedom to not have to deal with low-level drivers as well as the freedom to not have to program lower level managers 330, although lower level managers 330 may be accessible through game manager 304's interface if a programmer has the need. In addition to the freedom derived from not having to deal with the hardware level drivers and the freedom of having consistent, callable, object-oriented interfaces to software managers of those components (drivers), game manager 304 provides access to a set of high level managers 320 also having the advantages of consistent callable, object-oriented interfaces, and further providing the types and kinds of base functionality required in casino-type games. Game manager 304, providing all the advantages of its consistent and richly functional game application API 302 as supported by the rest of game kernel 300, thus provides a game developer with a multitude of advantages.

Game manager 304 may have several objects within itself, including an initialization object (not shown). The initialization object performs the initialization of the entire game machine, including other objects, after game manager 304 has started its internal objects and servers in appropriate order. In order to carry out this function, the kernel's configuration manager 321 is among the first objects to be started; configuration manager 321 has data needed to initialize and correctly configure other objects or servers.

The high level managers 320 of game kernel 300 may include game event log manager 322 which provides, at the least, a logging or logger base class, enabling other logging objects to be derived from this base object. The logger object is a generic logger; that is, it is not aware of the contents of logged messages and events. The game event log manager's 322 job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 323 manages the various meters embodied in the game kernel 300. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 323 receives its initialization data for the meters, during start-up, from configuration manager 321. While running, the cash in manager 324 and cash out manager 325 call the meter manager's 323 update functions to update the meters. Meter manager 323 will, on occasion, create backup copies of the soft meters by storing the soft meters' readings in EEPROM. This is accomplished by calling and using EEPROM manager 331.

In accordance with still other embodiments, progressive manager 336 manages progressive games playable from the game machine. Event manager 327 is generic, like game event log manager 327, and is used to manage various gaming machine events. Focus manager 328 correlates which process has control of various focus items. Tilt manager 332 is an object that receives a list of errors (if any) from configuration manager 321 at initialization, and during game play from processes, managers, drivers, etc. that may generate errors. Random number generator manager 329 is provided to allow easy programming access to a random number generator (RNG), as a RNG is required in virtually all casino-style (gambling) games. Random number generator manager 329 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 325 has the responsibility of configuring and managing monetary output devices. During initialization, cash out manager 325, using data from configuration manager 321, sets the cash out devices correctly and selects any selectable cash out denominations. During play, a game application may post a cash out event through the event manager 327 (the same way all events are handled), and using a call back posted by cash out manager 325, cash out manager 325 is informed of the event. Cash out manager 325 updates the credit object, updates its state in non-volatile memory, and sends an appropriate control message to the device manager that corresponds to the dispensing device. As the device dispenses dispensable media, there will typically be event messages being sent back and forth between the device and cash out manager 325 until the dispensing finishes, after which cash out manager 325, having updated the credit manager and any other game state (such as some associated with meter manager 323) that needs to be updated for this set of actions, sends a cash out completion event to event manager 327 and to the game application thereby. Cash in manager 324 functions similarly to cash out manager 325, only controlling, interfacing with, and taking care of actions associated with cashing in events, cash in devices, and associated meters and crediting.

In a further example, in accordance with one or more embodiments, I/O board server 315 may write data to the gaming machine EEPROM memory, which is located in the gaming machine cabinet and holds meter storage that must be kept even in the event of power failure. Game manager 304 calls the I/O library functions to write data to the EEPROM. The I/O board server 315 receives the request and starts a low priority EEPROM manager 331 thread within I/O board server 315 to write the data. This thread uses a sequence of 8 bit command and data writes to the EEPROM device to write the appropriate data in the proper location within the device. Any errors detected will be sent as IPC messages to game manager 304. All of this processing is asynchronous.

In accordance with one embodiment, button module 317 within I/O board server 315, polls (or is sent) the state of buttons every 2 ms. These inputs are debounced by keeping a history of input samples. Certain sequences of samples are required to detect a button was pressed, in which case the I/O board server 315 sends an inter-process communication event to game manager 304 that a button was pressed or released. In some embodiments, the gaming machine may have intelligent distributed I/O which debounces the buttons, in which case button module 317 may be able to communicate with the remote intelligent button processor to get the button events and simply relay them to game manager 304 via IPC messages. In still another embodiment, the I/O library may be used for pay out requests from the game application. For example, hopper module 318 must start the hopper motor, constantly monitor the coin sensing lines of the hopper, debounce them, and send an IPC message to the game manager 304 when each coin is paid.

Further details, including disclosure of lower level fault handling and/or processing, are included in U.S. Pat. No. 7,351,151 issued Apr. 1, 2008 entitled "Gaming Board Set and Gaming Kernel for Game Cabinets" the disclosure of which is incorporated herein by explicit reference.

Figure 4A:
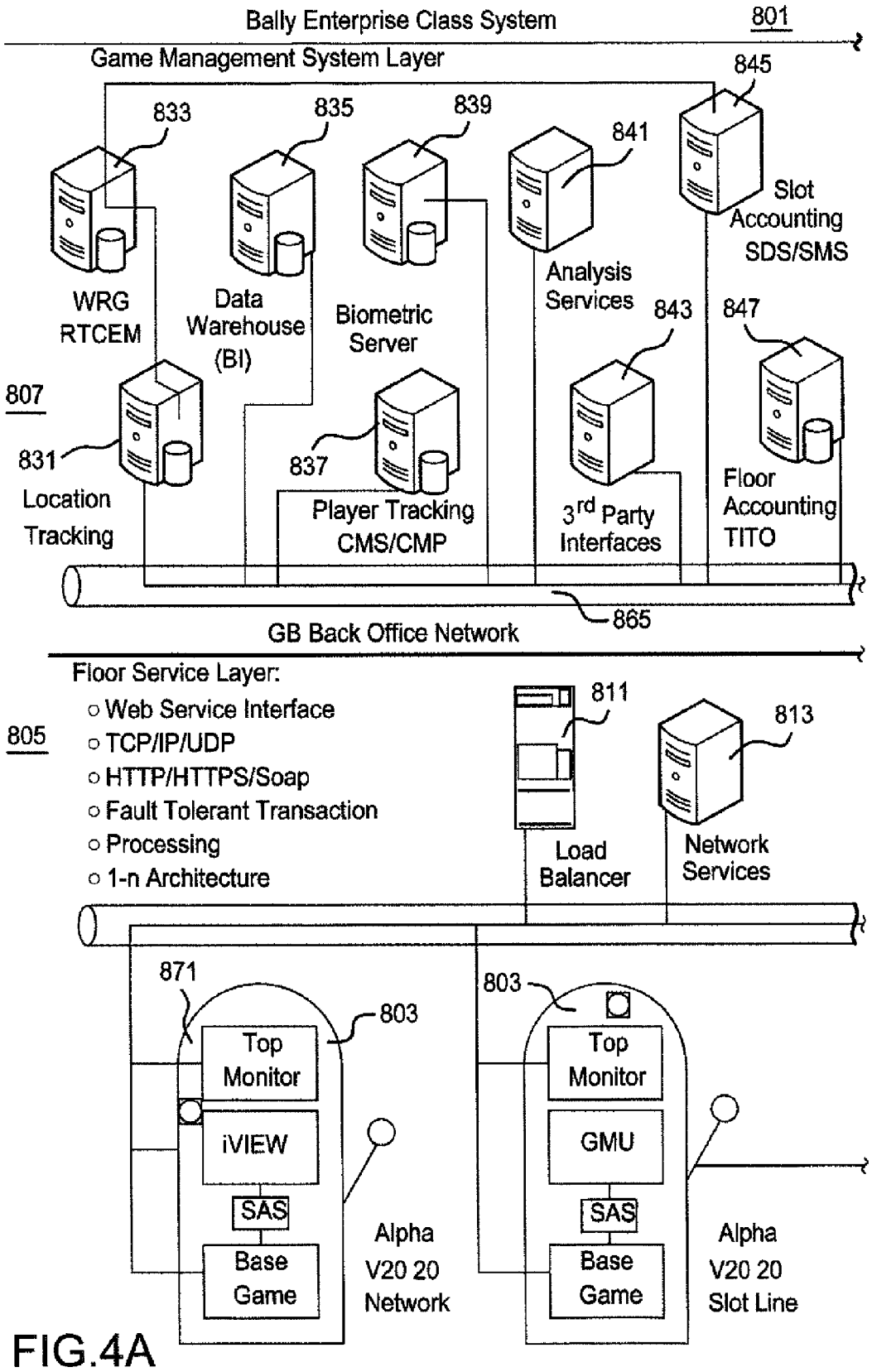
FIGS. 4A and 4B is a schematic of an example of a casino enterprise network incorporating gaming terminals.
Figure 4B:
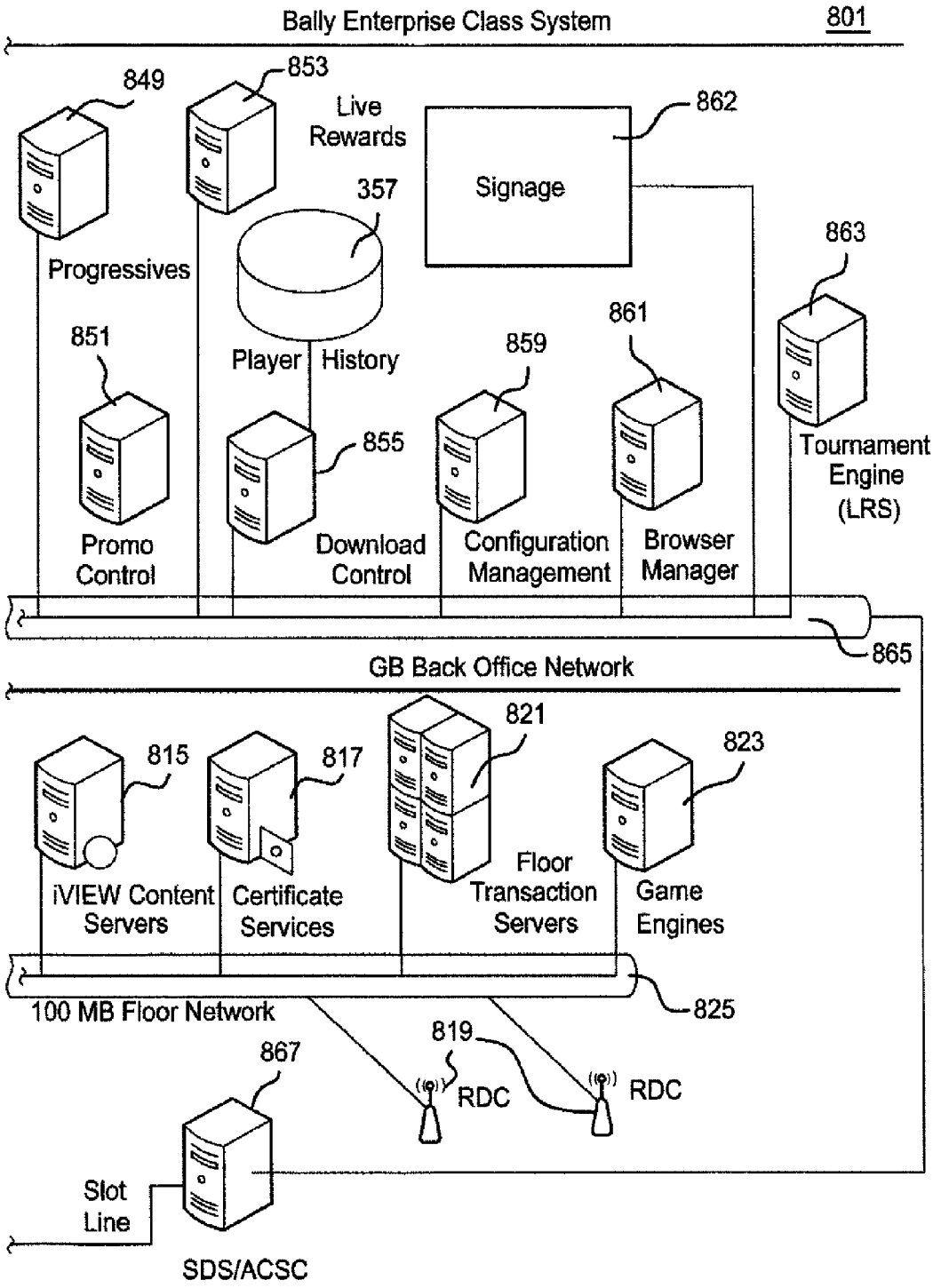

Referring to FIGS. 4A and B, an example of a gaming enterprise system 801 is shown in accordance with one or more embodiments. Gaming enterprise system 801 may include one casino or multiple locations (herein referred to collectively as a casino enterprise) and generally includes a network of gaming terminals 803 (including gaming devices 10 of the type as described in FIG. 1), floor management system (SMS) 805, and casino management system (CMS) 807. SMS 805 may include load balancer 811, network services server 813, player tracking module 28, iView (PTM 28), content servers 815, certificate services server 817, floor radio dispatch receiver/transmitters (RDC) 819, floor transaction servers 821 and game engines 823 (where the gaming terminals 803 operate server based, server supported or downloadable games), each of which may connect over network bus 825 to gaming terminals 803. CMS 807 may include location tracking server 831, WRG RTCEM (William Ryan Group Real Time Customer Experience Management from William Ryan Group, Inc. of Sea Girt, N.J.) server 833, data warehouse server 835, player tracking server 837, biometric server 839, analysis services server 841, third party interface server 843, slot accounting server 845, floor accounting server 847, progressives server 849, promo control server 851, bonus game (such as Bally Live Rewards) server 853, download control server 855, player history database 857, configuration management server 859, browser manager 861, tournament engine server 863 connecting through bus 865 to server host 867 and gaming terminals 803. The various servers and gaming terminals 803 may connect to the network with various conventional network connections (such as, for example, USB, serial, parallel, RS485, Ethernet). Additional servers which may be incorporated with CMS 807 include a responsible gaming limit server (not shown), advertisement server (not shown), and a control station server (not shown) where an operator or authorized personnel may select options and input new programming to adjust each of the respective servers and gaming terminals 803. SMS 805 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

The gaming terminals 803 include various peripheral components that may be connected with USB, serial, parallel, RS-485 or Ethernet devices/architectures to the system components within the respective gaming machine. The GMU (shown as GMU 206 in FIG. 2A) has a connection to the base game through a serial SAS connection. The system components in the gaming cabinet may be connected to the servers using HTTPs or G2S protocols over Ethernet. Using CMS 807 and/or SMS 805 servers and devices, firmware, media, operating systems, and configurations may be downloaded to the system components of respective gaming devices for upgrading or managing floor content and offerings in accordance with operator selections or automatically depending upon CMS 807 and SMS 805 master programming. The data and programming updates to gaming terminals 803 are authenticated using conventional techniques prior to install on the system components.

In various embodiments, any of the gaming devices 803 may be a mechanical reel spinning slot machine, video slot machine, video poker machine, video Bingo machine, Keno machine, or a gaming device offering one or more of the above described games including an interactive wheel feature. Alternately, gaming devices 803 may provide a game with an accumulation-style feature game as one of a set of multiple primary games selected for play by a random number generator, as described above. A gaming system 801 of the type described above also allows a plurality of games in accordance with the various embodiments of the invention to be linked under the control of a group game server (not shown) for cooperative or competitive play in a particular area, carousel, casino or between casinos located in geographically separate areas. For example, one or more examples of group games under control of a group game server are disclosed in Vallejo et al U.S. Published Application 2008/0139305, entitled "Networked System and Method for Group Gaming," filed on Nov. 9, 2007, which is hereby incorporated by reference in its entirety for all purposes.

The gaming system 801, among other functionalities such as slot accounting (i.e. monitoring the amount wagered ("drop"), awards paid) and other casino services, includes the player tracking CMS/CMP server 837 and/or data warehouse 835 storing player account data. This data includes personal data for players enrolled in the casino players club sometimes referred to as a loyalty club. An example of the personal data is the player's name, address, SSN, birth date, spouse's name and perhaps personal preferences such as types of games, preferences regarding promotions, player rating level, available player comp points (points accumulated based upon commercial "spend" activity with the enterprise including gaming and which may be redeemed or converted into cash or merchandise) and the like. As is known in the industry and according to the prior art, at enrolment the player is assigned a created account in the player tracking CMS/CMP server 837 and is issued a player tracking card having a machine readable magnetic stripe.

It should be noted in connection to the above that the casino enterprise retains (virtually) the comp points in the players accounts. These comp points may be considered a liability inasmuch as some time in the future the player may seek to redeem or convert those points. Often such points may be redeemed/converted by a player proactively requesting the cash value or though redemption and retirement of points used to pay for things such as meals, shows, merchandise or lodging. It would be advantageous if an additional means were provided to an enterprise to incentivize redemption and retirement of player comp points to decrease any comp point related carried liability.

When a player plays a gaming device 10 (or terminal 803) (hereinafter collectively referred to as gaming devices 10), he/she inserts their player tracking card into the card reader 32 (FIG. 1) which communicates data to the CMS/CMP server 837 to accumulate loyalty ("comp") points based upon the wagers/wins of the player. For example, a player may accumulate one comp point for each $5 wagered. Comp points may also be awarded as part of a promotion and for other commercial activity such as the purchase of goods or services.

The system 801 may also include electronic transfer of funds functionality. For example, a player having accumulated $100 at a gaming terminal 10 may decide to "cash out" to play another gaming terminal 10. The player, for example using the PTM 28 to initiate communication with the system 801 for example server 837 to upload the value from the gaming terminal 10 into an electronic account associated with the player's account. The player may choose to upload all or a portion of the funds the player's established electronic account. The system would prompt the player to enter their PIN (or obtain biometrical confirmation as to the player's identity) and upload the chosen amount to their account. When the player moves to another gaming terminal 10 he/she inserts their player loyalty card into the card reader 32 to access their account. A prompt provides for the player to request funds from their account. Entering their PIN (or biometric identifier) the player can input the desired amount which is downloaded to their gaming terminal 10 for play.

Figure 5:
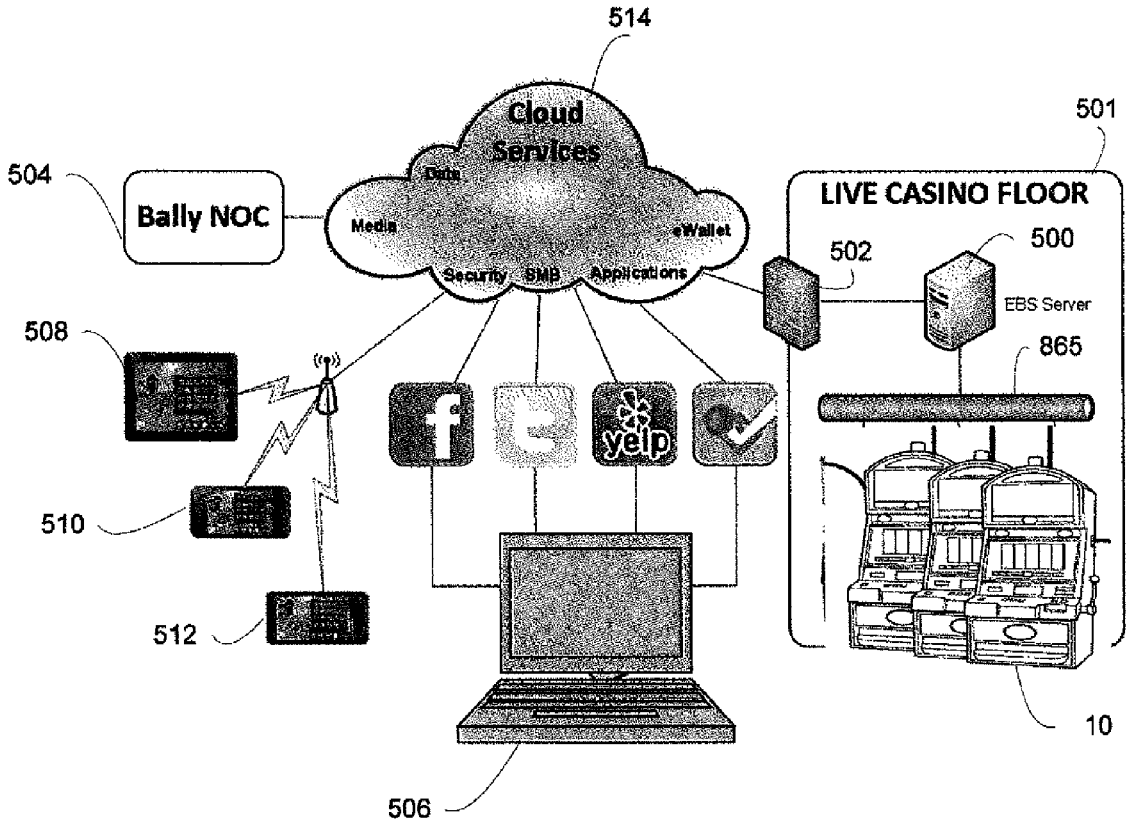
FIG. 5 is a diagram showing an example of an architecture for tying a casino enterprise network to an external provider of games and content to Internet or broadband communication capable devices.

Portions of the present invention may be implemented or promoted by or through a system as suggested in FIG. 5. At 501 is the gaming enterprise system which may be hosted at a casino property enterprise, across several casino enterprises or by a third party host. As described above the gaming enterprise system 501 has a network communication bus 865 providing for communication between the gaming devices 10 and various servers as described above with respect to FIGS. 4A,B. To provide the functionality illustrated in FIG. 5, a feature server 500, such as a Bally Elite Bonusing Server, is connected to the network communication bus 865 for communication to the gaming system 801, the gaming devices 10 and the various servers and other devices as described above. Through a secure network firewall 502 the feature server 500 is in communication with a cloud computing/storage service 514 which may be hosted by the casino enterprise, a licensed third party or if permitted by gaming regulators an unlicensed provider. For example the cloud service 514 may be as provided by Microsoft® Private Cloud Solutions offered by Microsoft Corp. of Redmond, Wash., USA. The cloud service 514 provides various applications which can be accessed and delivered to, for example, personal computers 506, portable computing devices such as computer tablets 508, personal digital assistants (PDAs) 510 and cellular devices such as telephones and smart phones 512. For example the cloud service 514 may provide and support the enterprise applications in association with the feature server 500. The cloud service 513 may also facilitate the delivery of content to user/players by supporting updates and advertising through the enterprise applications to the remote device user/player. The cloud service 514 includes security provide for secure communication with the cloud service 514 between the player/users and the cloud service 514 and between the cloud service 514 and the gaming enterprise system 501. Security applications may be through encryption, the use of personal identification numbers (PINS), biometric identification, location determination or other devices and systems. As suggested in FIG. 5 the cloud service 515 stores or accesses player/user data retrieved from players/users and from the gaming enterprise system 501 and feature server 500.

The players/users may access the cloud service 514 and the applications and data provided thereby through the Internet or through broadband wireless cellular communication systems and any intervening sort range wireless communication such as WiFi. The players/users may access the applications and data through various social media offerings such as Facebook, Twitter, Yelp, MySpace or LinkedIn or the like.

As but an example, a player/user may have a player account with a casino enterprise. That account may include data such as the player's credit level, their rating and their available comps. At their smart phone 512 the player/user sends a request to the cloud service 514 (perhaps through a previously downloaded application) to request a the status of their available comps such as how many comp points they have and what may be available through redemption of those points (e.g. lodging, cash back, meals or merchandise). The application for the request may present casino promotions, graphics or other advertising to the player/user. The application, to support such a request, would typically require the player/user to enter a PIN or some other unique identifier such as a biometric identifier or tag. The cloud service 514 forwards the inquiry to the feature server 500 which, in turn, confirms the identification and retrieves the requested information from the data warehouse 835 or player history database 857 or player tracking CMS/CMP server 837. The information is formatted by the cloud service 514 application and delivered to the player/user. The delivery may be formatted based upon the player/user's device operating system (OS), display size or the like.

The cloud service 514 may also host game applications to provide virtual instances of games for free, promotional, or where permitted, P2P (Pay to Play) supported gaming. Third party developers may also have access to placing applications with the cloud service 514 through, for example a national operations center (Bally NOC 504). A game software manufacturer such as Bally Gaming, Inc. may also provide game applications on its own or on behalf of the casino enterprise.

Other media such as advertising, notices (such as an upcoming tournament) promotions and surveys may also be provided to and through the cloud service 514. When a player/user accesses the cloud service 514 certain media may be delivered to the player/user in a manner formatted for their application and device.

The cloud service 514 enables the casino enterprise to market to and foster player loyalty. To drive such interaction various incentive programs may be employed including, as described above, users earning or being awarded mystery game chances which may be redeemed at their next visit to the casino enterprise or, where permitted, during play on their remote devices. As described herein the cloud service 514 enables the user/player to access and interact with their one or more virtual objects.

Virtual Objects

Figure 12:
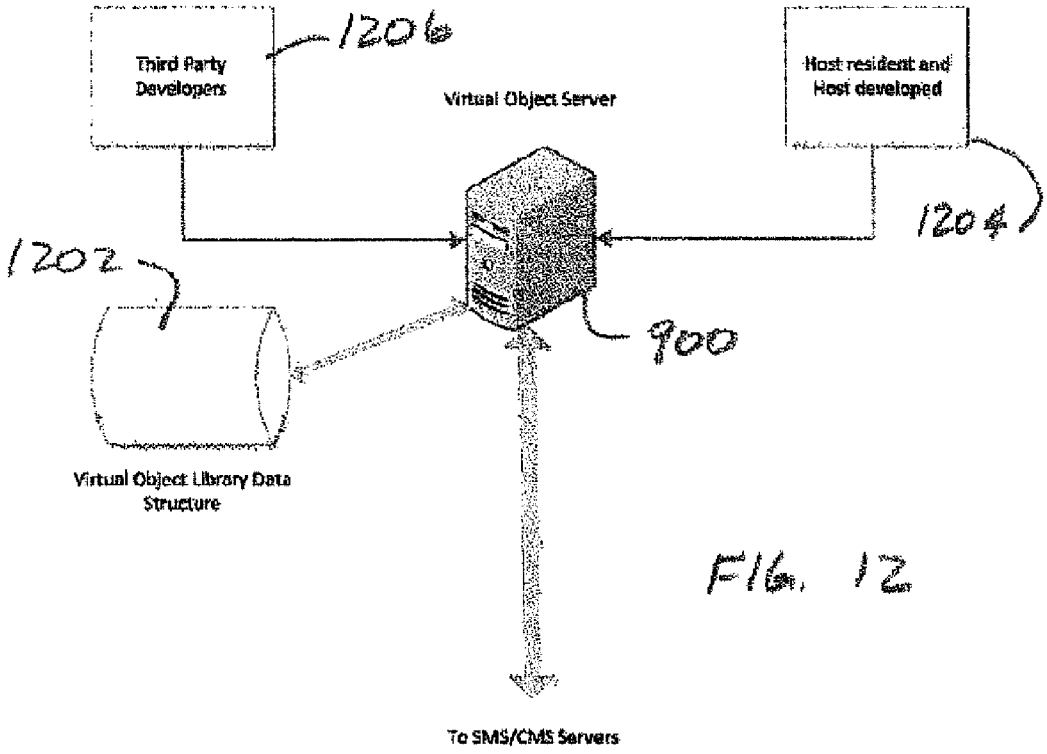
FIG. 12 shows the an embodiment of an architecture for the acquisition, storage and deployment of virtual objects and attributes.

With reference to FIG. 12 the present invention according to an embodiment includes the virtual object server 900 configured to execute code to access, maintain and arrange a virtual object library (VOL) data structure 1202. The virtual object server 900 and VOL data structure 1202 may be located in a casino enterprise venue or may be located remotely or may be hosted by third party such as a third party provider of the system and methods described herein. For example, a third party provider may co-locate the virtual object server 900 and VOL data structure 1202 to service various enterprises. The virtual object server 900 and VOL data structure 1202 may be embodied as one or more existing servers and data structures at the casino enterprise such as one or more of the of the servers and data warehouses described above with reference to FIGS. 4A,B or as the feature server 500 of FIG. 5.

Figure 14:
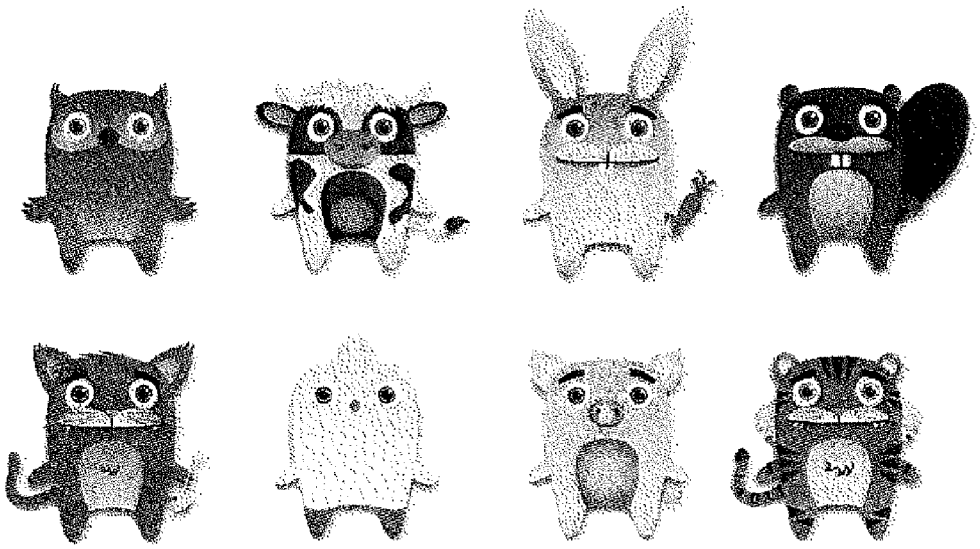
FIG. 14 shows several embodiments of virtual object pets for acquisition by a player/user.

The virtual object server 900 and VOL data structure 1202 are configured to provide for the acquisition and data storage of graphics and software code related to one or more virtual objects and graphics renditions and animations. The virtual object server 900 is in communication with the feature server 500 to coordinate delivery of the content to the players as herein described. The virtual objects, as defined herein, are graphic objects which are typically animated representations of animals, things or environments which preferably are suitable for outfitting with attributes such as accessories, equipment or stock or which include an attribute which, if not maintained, will diminish over time. As but some examples the objects may be pets (as shown in FIG. 14), zoo animals, race horses, wild animals, automobiles including race cars and classic cars, musicians, bands, aircraft, boats and yachts, farms, ranches, business enterprises such as stores or casinos, sports teams or people such as models, astronauts or the like. These objects can be outfitted, upgraded, modified or stocked with attributes including accessories and accoutrements which can be acquired. Using a virtual pet dog as a non-limiting example, graphics are created (or subject to creation by a software module) to show the pet dog preferably in animated form (or at least subject to occasional animation). The pet dog may be outfitted with attributes such clothes, leashes, collars, toys, tricks, a dog house or training to "upgrade" the pet. Further, the pet dog may have one or more attributes which can be altered over time. These attributes may be exhibited by graphics showing that the pet is hungry, thirsty, sad, bored or lonely. Attributes may relate to maturing, evolution or modification such as a kitten becoming an adult cat or tiger or a puppy maturing into an adult dog. A musician may evolve, though acquisition of features/objects from a novice to an accomplished artist. Using the virtual pet as an example, the graphics packages stored at the VOL data structure 1202 are configured for rendering the pet, when first initialized, in a first state with a first set of attributes. These attributes may be youth, happiness and very few, if any, accessory attributes. In an embodiment the pet may be configurable such as a user selecting from a library of dog images and defining the appearance such as color, breed, size, or the like. A user may import an image of their pet to be incorporated into the virtual pet graphic package. As described herein, users/players, according to the systems and methods of the present invention, will be able to view and interact with their virtual pet and be awarded, acquire, trade for, barter or restore attributes to their pet such as by re-invigorating their pet, satisfying their pet's hunger or thirst and acquiring accessories such as toys, collars, leashes, dog houses, etc. It should be understood that where the virtual object is, for example, a farm the user/player will be able to view their object and acquire or restore attributes. The user/player may acquire or be awarded livestock, crops, buildings, equipment or the like. The farm may include an attribute which can diminish over time such as the health state of the livestock or crops or the condition of buildings or equipment.

Preferably each graphic data package for a virtual object stored at the VOL data structure 1202 is configured to include library data representing associable attributes such as accessories which can be awarded and/or acquired as well as graphics to support rending of the object showing attribute changes such as the appearance after acquisition of an attribute, i.e. the pet with a new collar, or the re-establishment or restoration of an attribute which has diminished, i.e. a lonely pet transformed into a happy pet.

It should be understood that the recitation above of examples of virtual objects is not meant to be limited but is merely set forth by way of example.

As shown in FIG. 12, the host enterprise such as a casino resort enterprise at 1204 develops or populates the virtual object related data through the virtual object server 900 to the VOL data structure 1202. The host may be provided with a software/graphics development kit so their internal developers may create virtual object graphics packages perhaps related to the theme of the enterprise. Additionally and alternatively at 1206 third party developers may provide graphics packages as commissioned/selected/purchased/licensed by the enterprise.

With reference to a casino enterprise embodiments the systems and methods of the present invention will now be described. The feature server 500 is in communication with the virtual object server 900 and casino SMS/CMS servers 837 and 845 (FIG. 4A). The servers and data bases 837, 845, 357 are configured for a player at a casino to establish a player account for the player which may include personal information and be associated with a security key such as a PIN (personal identification number) through which the player may acquire access to their account. As is known in the art when the player enrolls the player is typically issued a player loyalty card with a machine readable element. When a player plays a gaming device 10 they insert their card into the device card reader 32 which reads the machine readable element and associates the player's activity with their account. As is known in the art the casino may award comp points to a player based upon their level of play at the gaming device 10. Comp points are also awarded based upon the player's play of live games such as Blackjack, Craps and like as well. The systems and methods as hereinafter described can also be used with anonymous, un-enrolled players, who may simply choose to use a unique PIN or other identifier such as a biometric identifier rather than engage is a formal enrollment. Remotely the user/player, as described below, accesses their file by using a PIN, their account number and, if required or available, a portable device magnetic stripe reader of the type such as available through Square, Inc., San Francisco, Calif.

a. Acquisition of Virtual Objects

To provide a virtual object to a player, according to an embodiment, the player first selects their desired virtual object. For example, the player may select the virtual object from a library of objects stored at the VOL (Virtual Object Library) data structure 1202 when they enroll with the casino loyalty award program. The player may also establish their virtual object at a gaming device 10 or kiosk (not shown). As but an example, a kiosk within the casino enterprise physical venue may be linked to the feature server 500 and/or SMS/CMS servers 837, 845. The player, at a card reader, positions their card for reading to establish a communication link between the kiosk and their player account. The kiosk would offer, for example, one or more virtual objects for selection by the player. The player makes their selection (and its configuration, if available) of their virtual object in its initial state which is then tied to the player's casino account. The tie may be simply a link, pointer or tag to a data file at the VOL data structure 1202 or the graphics package application(s) may be stored at the player's account file. Various other links may be employed such as a combination of the foregoing or providing a link to a software or graphics package hosted elsewhere such as at the cloud service 514. As described herein the user/player may also access a website or social network site associated with the casino enterprise from a remote device such as a PC, laptop, PDA or smart phone to open an account and initialize their selected virtual object or, if they already have an account, access their account and initialize their virtual object.

Figure 9:
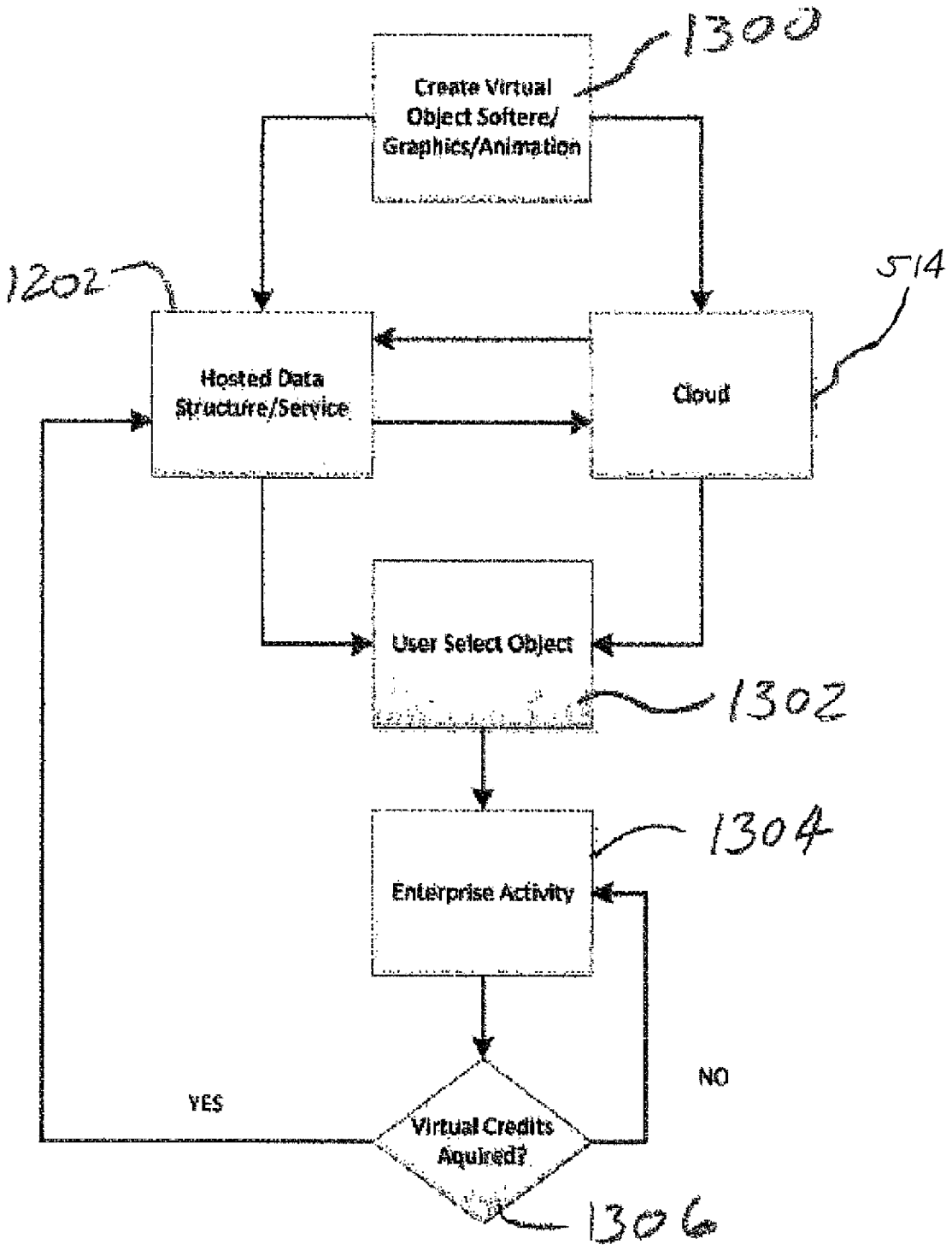
FIG. 9 is a logic diagram directed to selection of a virtual object and the award of virtual credits.

FIG. 9 is a logic diagram related to the foregoing description. At 1300 the virtual object(s) software and graphics animation packages are created and stored at the VOL data structure 1202 as described above. This data may be propagated to or accessed from the VOL data structure 1202 by the cloud 514 according to an embodiment. At 1302 the user initializes their virtual object such as, for example, selecting a virtual dog as their object and perhaps assigning a pet name. The virtual dog would then be rendered for the user/player to view. Graphics packages enable the user/player to interact with their virtual pet such as petting or scratching the pet. The graphics package may render the dog in animation engaged in activities and speaking to the user/player.

At 1304 in FIG. 9 the user/player engages in activities at the enterprise physical venues such as a casino. The activities may be gaming or purchasing of goods or services. One or more of the SMS/CMS servers 837, 845 or feature server 500 (FIG. 5) is configured to award virtual currency at 1306 when the user/player engages in designated enterprise activities. According to an embodiment virtual currency may be of one of several classes. For example, Class A virtual currency may be awarded for commercial activities at the casino venue such as gaming or purchasing of goods/servers whereas Class B virtual currency may be awarded for other activities as well such as activities from remote devices. For example, the user/player may visit a social network site such as Facebook® and be awarded class B virtual currency for "liking" the casino, for responding to a survey or for playing entertainment games or the like. Where legal, remote pay-to-play (P2P) gaming at a user/player's computer or smart phone may earn the player class A and/or class B virtual currency. The currency awarded or earned by a user/player is associated with the player's account for later redemption. In addition to earning virtual currency through providing some type of consideration, currency of any class may be awarded to players as part of a promotion, for engaging is a specified activity such as playing a new game or dining at a specified restaurant or for frequenting a marketing partner such as purchasing tickets from a partnering airline, test driving a vehicle at an auto dealership or the like. As shown in FIG. 9 the awarded and earned virtual currency is stored in a data structure, be it the SMS/CMS servers 837, 845 or feature server 500 and is associated or tied to the user's/player's account. Award, earning and redemption protocols are stored and executed by the feature server 500. The user/player may also acquire virtual currency though purchase or redemption of comps awarded by the enterprise such as comp points awarded for gaming. Thus the casino may continue with its traditional awarding of comp points; but provide a mechanism for the player to either convert the comp points to virtual currency (class A and/or class B) or may enable the player to directly retire the comp points to acquire attributes, accessories of accoutrements for their virtual pet.

As described herein the virtual currency awarded to or earned by a player is available for the player to redeem to purchase, restore or renew attributes of the virtual object, in this example, their virtual pet dog. In an embodiment certain attributes may be acquired, restored or renewed with only Class A virtual currency. As but an example, when the virtual pet dog is first initialized it may be in a well-fed, happy condition such as a happy puppy. The attributes of emotion and/or physical condition may be Class A attributes which can only be affected using Class A currency. If a player has not visited the casino venue for a period of time his/her virtual pet dog may become sad and may speak to the owner beckoning the owner to redeem awarded/earned Class A virtual currency to make the dog happy. As can be appreciated if the player has expended their Class A virtual currency a return visit to the casino may be suggested. Thus by providing different classes of virtual currency, a player may be encouraged to visit the casino enterprise venue. In certain embodiments gaming credits on gaming machines or cash, eCash or credit card payments may be used as substitutes for at least Class A virtual currency. Player comp points may also be used or converted to virtual currency. By using player comp points (awarded separately from virtual currency) the casino may encourage retirement of the carried liability of comp points through servicing the virtual pet. For example, if a player does not have any Class A virtual currency and their pet is hungry, the player may be able to convert their comp points or pay money to acquire virtual Class A currency which, in turn, can be used to restore the pet to a fed condition.

Figure 13:
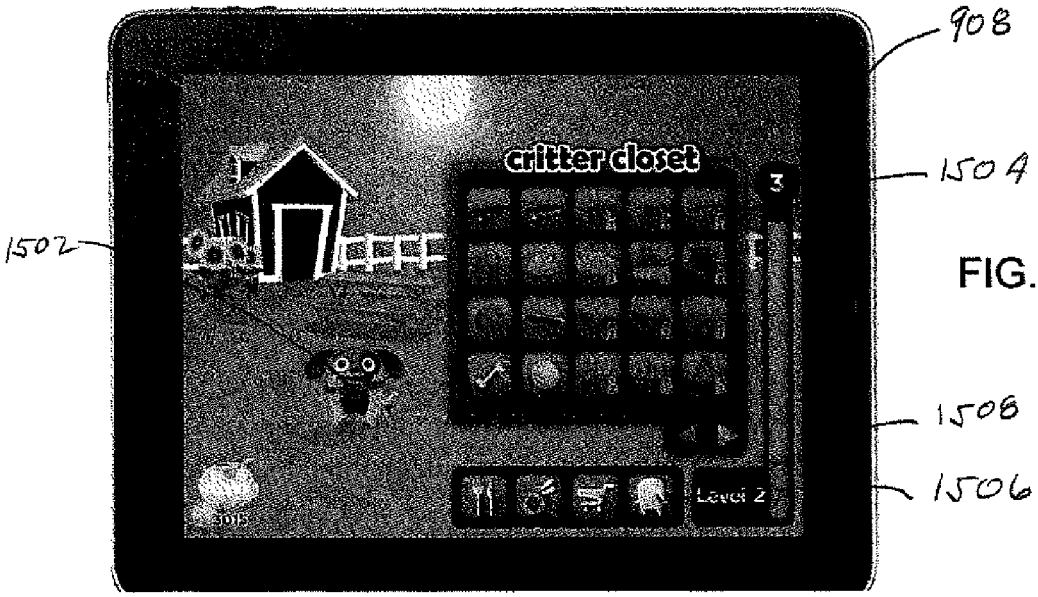
FIG. 13 shows an example at a display of a remote tablet computer showing the virtual object (dog) and the accessories available for acquisition.
Figure 10:
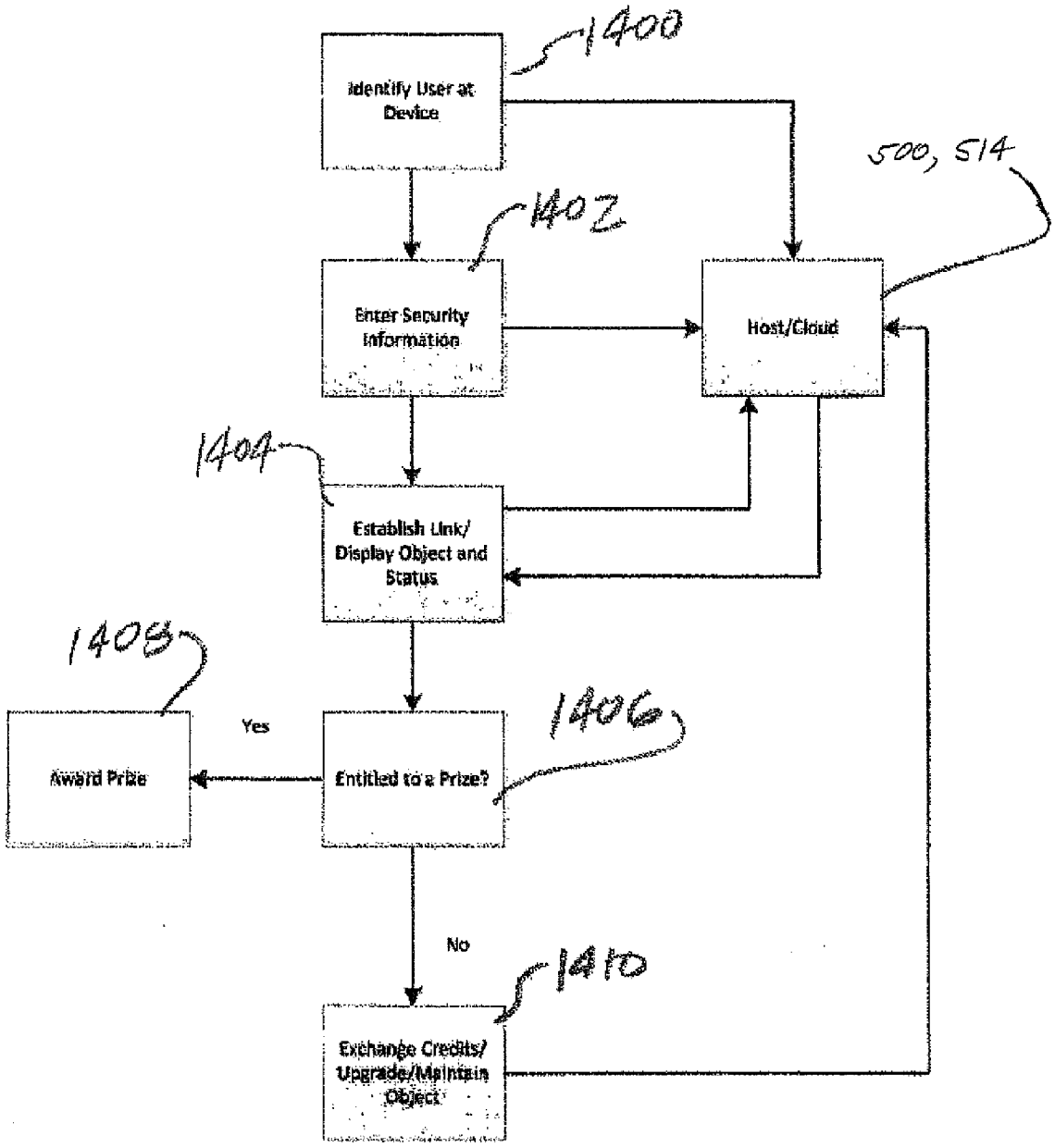
FIG. 10 is a logic diagram showing an embodiment where the enterprise may award an attribute directly or a user/player may redeem virtual credits to acquire attributes.

FIG. 10 shows how a player may redeem virtual currency to acquire or restore attributes to their virtual pet dog. At 1400 the player establishes their identity with a device which communicates with the system servers as described above. This step may be done by a player at the casino venue inserting their player loyalty card into a gaming device's 10 card reader 32. Where the player is accessing remotely, the player may enter the casino enterprise website or social media site at 1400. There the player identifies himself by, for example, entering the account number from their player tracking card or swiping their player card in a remote device compatible card reader. At 1402 the player gains access to their account by entering security information such as their PIN number. At 1404 a link is established and the graphics package controls a display on the gaming device 10 or the player's remote device to display their virtual pet and with its then current condition attributes and status. The display may include animation to enhance the user/player experience. The system may also display a selection of attributes available for acquisition by the player. FIG. 13, for example, shows an example of a remote tablet computer device 908 displaying the virtual dog 1502 and a matrix of available attributes 1504. The site may also display icons 1506 which may be selected to access other offerings at the site such as restaurant listings, stores, promotions, activities or the like for the user to view and perhaps book a reservation or purchase merchandise. In an embodiment a level meter 1508 may also be displayed which informs the user of the level of accessories available and how near, based upon the players activities, they are to opening the next level of attributes, e.g. accessories. For example, new players or players have a low casino rating may be entitled to only level 1 attributes such as simple collars, leashes, toys or the like. Players of higher ratings are entitled level 2 attributes such as additional or embellished attributes such as dog houses, diamond studded collars, fancy dog houses and the like.

When the player accesses their virtual pet and the same is displayed at their remote device or gaming terminal 10, the enterprise may introduce advertising to the player. Advertising can relate to goods/service provided by the enterprise or may be, for example, paid for advertising from a third party such as an airline, or automobile company.

In an embodiment, in lieu of or in addition to providing different classes of virtual currency, certain attributes may only be acquired/restored at the casino venue. For example, a single virtual currency is awarded or earned; however it may be redeemed for certain class A attributes only at the casino venue. Thus if the virtual dog is sad, the attribute of happiness may not be restored remotely. The player must instead visit the casino and redeem virtual currency at a kiosk or gaming device 10 to restore the virtual dog's happiness. This feature is an alternative way to encourage the player to return to the casino.

Returning to FIG. 10, once the player has established the link the system may determine at 1406 if the player is entitled to a prize. The prize may be a promotional prize or a prize from a drawing. In an embodiment where the player has established the link at a gaming device 10 at the casino venue, the system determines whether the player has won a jackpot at the gaming device 10. In either event at 1408 the prize is awarded to the player. The event of winning a jackpot or prize may define one or more events which trigger an offer to the player to acquire attributes for their virtual pet. For example, when a player establishes the link as described above, the system may award the player virtual currency or an attribute outright as a promotion or from a drawing to the player. The attribute awarded may be a new collar or leash for their virtual pet. When the player's win of a jackpot at the gaming device 10 is a trigger, the offer may consist of the system opening or augmenting a display of the virtual pet to suggest that the player redeem virtual currency to acquire an attribute for their pet or to allocate some of their game credits (which are convertible to actual currency) to acquire an attribute for their pet. As an example, the player may win a $200 jackpot at the gaming device 10 they are playing. This event is detected by the SMS/CMS servers 837, 845 or feature server 500 to which the gaming device 10 is linked triggering the display of the virtual pet to call up a menu of available attributes such as a matrix of available attributes 1504 (FIG. 13). The player may then redeem virtual currency, comp points or exchange value such as by using game credits, cash or value from an electronic account at 1410 to acquire or restore attributes or acquire accessories. The same description applies where the player logs into their account from a remote location. They may be awarded virtual currency or prizes based upon their interaction with the website/social site and offered the opportunity to redeem prizes or virtual currency for attributes. As stated above certain attributes are preferably tied to activities which take place at the physical casino venue to encourage the player to visit the casino. This "tying" may be by providing different classes of virtual currency with one or more classes restricted to certain acts or events at the casino venue and/or by providing that certain attributes/accessories that can only be acquired/restored at the casino venue. For example, "happiness" of the virtual dog may only be able to be restored at the casino venue or by using a certain designated class of virtual currency.

Figure 11:
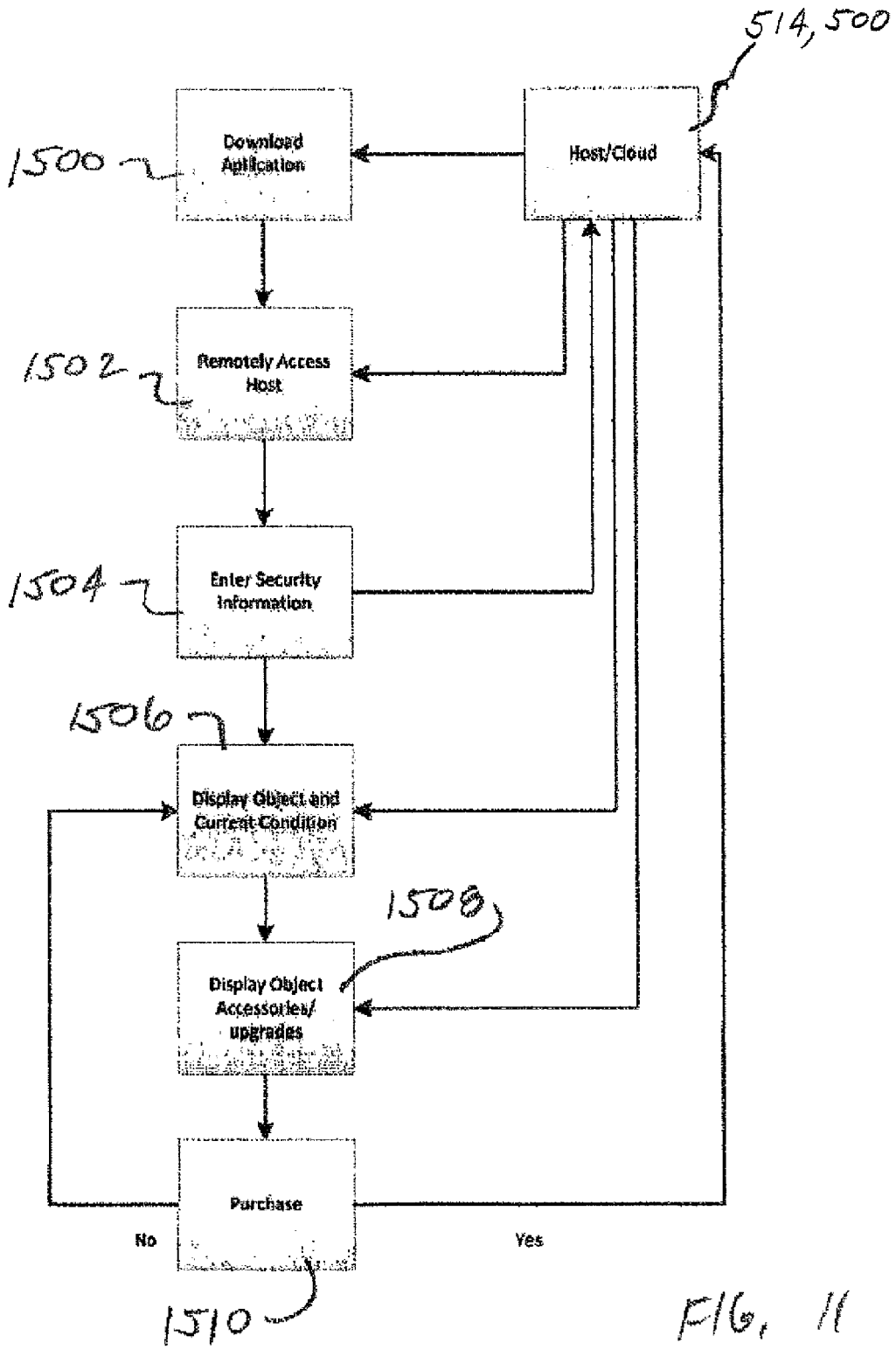
FIG. 11 is a logic diagram for a user/player to remotely access their virtual object and acquire attributes.

Turning to FIG. 11 an embodiment showing a remote access feature of the present invention will be described. At 1500 the player downloads a software application providing access to their account, virtual object and graphics packages. The application may come for the feature server 500 described above or the cloud 514. Using the application the player at 1502 remotely accesses the feature server 500 and at 1504 enters security information to enable access. The feature server 500 and/or cloud 514 and/or virtual object server 900 and VOL library 1202 cooperate to display at the player's remote display at 1506 the player's virtual object, e.g. virtual pet dog, in its current condition/state. The system (cloud 514 and/or feature server 500 and/or virtual object server 900 and VOL library 1202 network) may also display at 1508 attributes available for acquisition (accessories, upgrades, conditions) by the player through redemption of virtual currency, cash, electronic currency or prize redemption. The player may, at 1510, choose to acquire available attributes for their virtual object or decline acquisition. The player may interact with their virtual dog supported by the graphics and animation packages of the application, cloud 514 and/or feature server 500 and/or virtual object server 900 and VOL library 1202. The animation may show the virtual dog playing and may react to commands and actions of the user to establish a bond between the user and their virtual dog. The player may also select or be presented with, for example, a game to play which may earn the player virtual currency.

Turning to FIGS. 6-8 and 14 examples of displays according to embodiments of the invention will be described. In FIG. 6 there is shown a display 1600 showing the virtual pet dog 1502 in an environment such as a yard. Displayed with the dog 1502 is a game 1602 which may be, where the display 1600 is related to P2P gaming, a primary wagering game. The primary game 1602 may be confined to a window in the display 1600 or, alternatively, the virtual dog 1502 and its environment may be confined to a window adjacent or below the primary game 1602. Display 1600 also shows celebration graphics indicating that the player has been awarded virtual currency. A graphic piggy bank 1604 indicting the amount of available virtual currency may be shown as well. The display 1600 may also show the icons 1506 and level meter 1508. At FIG. 7 the display 1600 shows that the player has redeemed virtual currency (cash or comp points) to feed his/her dog and the graphics software renders a message 1700 from the dog 1502 that the dog has been fed and "is stuffed".

Figure 8:
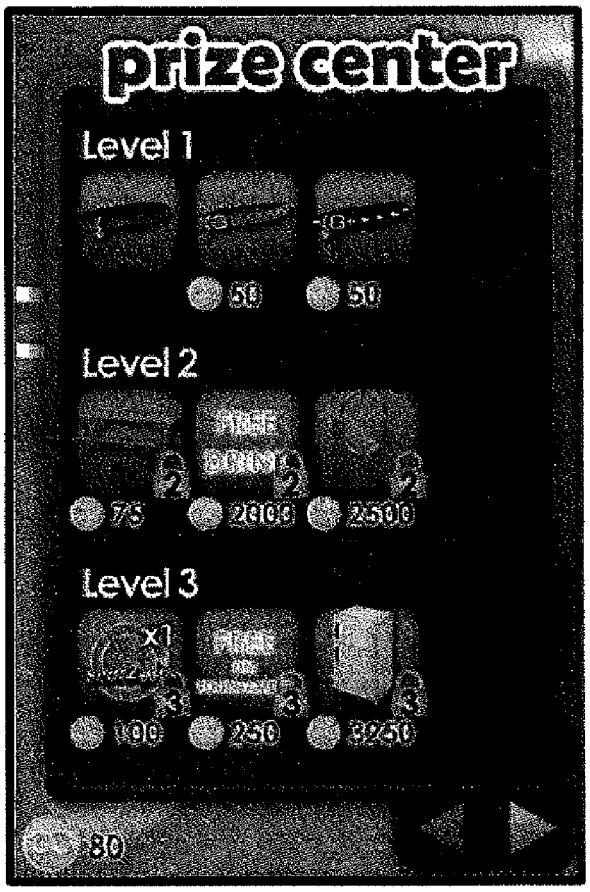
FIG. 8 illustrates a display of an attribute store prize center.

FIG. 8 shows a display 1800 provided by the graphics software associated with the virtual object which shows the various attributes such as accessories which may be offered for acquisition from a virtual store. Based upon the level of the player, such as their rating with the casino, different accessories may be offered for acquisition. At Level 1 the player may acquire a dog collar from a selection of collars. Each collar may have assigned to it a different redemption value such as the virtual currency required for acquisition. At Level 2 the player may acquire a picnic table, a dog agility device or may be awarded a free spin. At level 3 the player may be awarded a spin of a promotional wheel, a tournament entry or a product such as a refrigerator.

FIG. 14 shows some examples of virtual animals which can be awarded to or selected by a player. It should be understood that the virtual object, as stated above, need not be an animal or pet but could be a virtual race car, a person, a farm, ranch, casino, rock band or the like.

The systems and method described herein may be used to engage the customers within the enterprise venue and also remotely. The users interact with the enterprise to maintain their virtual object such as feeding a virtual animal or virtual livestock or replenishing stock for an enterprise and can upgrade their object. The virtual objects may also be used as vehicles for tournament, bonus, progressives or community play. For example, in a tournament, players may play to acquire designated attributes for their virtual object and win the tournament when all attributes have been acquired. As but an example, players may interact with the enterprise to compete to acquire all of the accessories for a virtual race car. During this competition the enterprise may award accessories as interim prizes. Acquisition of attributes may also be used to provide bonuses or promotions to users. For example, if a user makes a specified purchase or spends an amount of money or a player wins a designated jackpot, the enterprise may award attributes and value prizes to the user/player. Virtual object maintenance and attribute acquisition may also be used to deplete player comp points awarded by a casino or other enterprise is lieu of the user redeeming them for goods or services. Virtual object maintenance and upgrades may also be used to increase revenue where users/players can purchase attributes for money or value credits. Still further the virtual object scheme may be used to support promotions such as Internet or broadband based promotions, in-venue promotions or mailer promotions. User/players may be offered attributes/virtual currency, with or without value prizes, for engaging in certain activity. As but an example, players accessing the system remotely may be offered virtual currency for booking a stay at a casino enterprise or making restaurant reservations.

Figure 15:
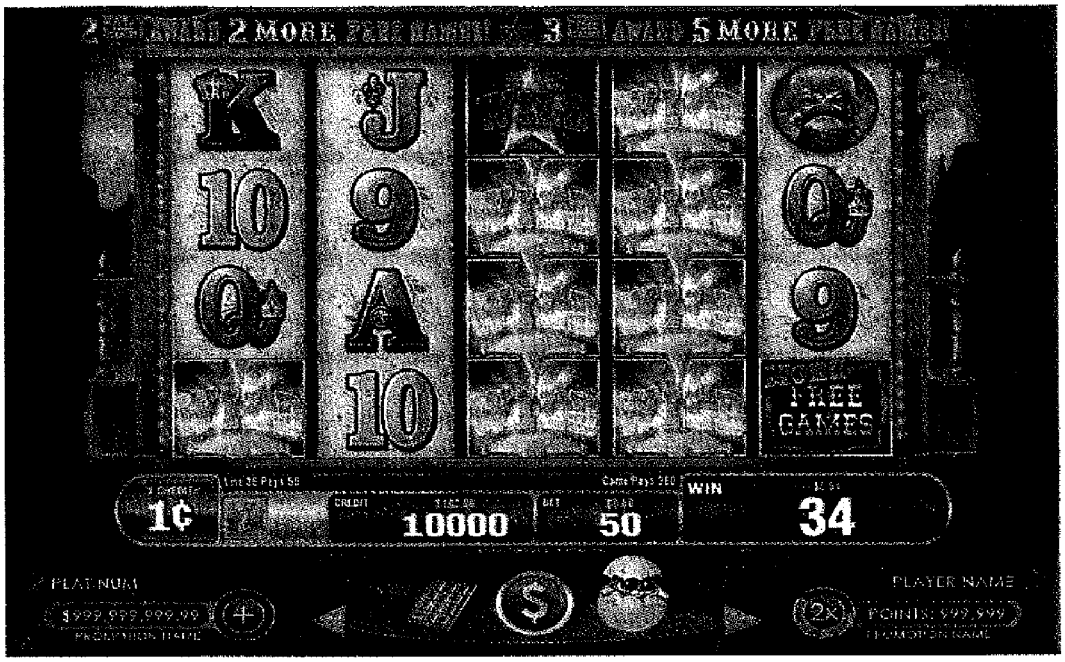
FIG. 15 shows a gaming device display and an embodiment for initializing a virtual pet for a player.

In an embodiment players must earn their virtual object. For example, and with reference to FIG. 15, when the virtual object program is initiated by the casino enterprise identified players of gaming devices 10 may see at a location at the primary game display 14, secondary display 18, or PTM display 30 an image of an unbroken egg. As the player plays the gaming device and earns comp points and/or virtual currency the system and method of the present invention would control the display to depict the egg as beginning to hatch. When the player has engaged in sufficient activity such as having wagered a minimum amount, the egg would hatch releasing the virtual pet for the player. FIG. 15 depicts the virtual object pet hatching from the egg.

Once established the system and method of the present invention according to an embodiment may control the image of the virtual object, such as a virtual pet, to react to certain events. For example, when a player initiates play, the virtual pet may engage in a celebratory animation and/or issue a celebratory message such as "Welcome Back John". Celebrations may also be associated with events such as the player winning a jackpot, cashing out, providing more funds for gaming, or events such as birthdays and holidays.

b. Virtual Objects Unlock Features

Virtual objects may also be used to unlock game/system features such as tournaments, bonuses, multipliers, progressives and game enhancements. In a simple example, a player must earn or acquire a virtual object (such as a virtual car) to be eligible to participate in a promotional drawing for a new car. In another example, and not by way of limitation, where a player has acquired attributes for their virtual pet to a predetermined level, the player may be entered into a promotional drawing, tournament or receive a bonus. Primary game features may also be opened to the player such as bonus games or award multipliers when a virtual object acquisition level has been attained. Accordingly it should be understood that the virtual object may be employed to enhance the player's gaming experience and loyalty to the casino enterprise.

Figure 16:
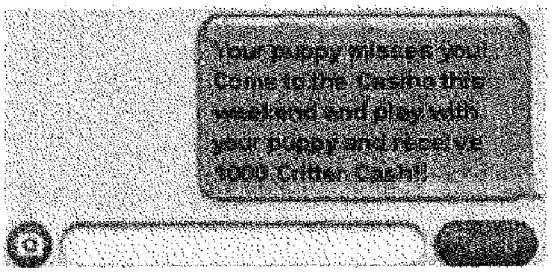
FIG. 16 shows several views of marketing by an enterprise through social media content.
Figure 16:
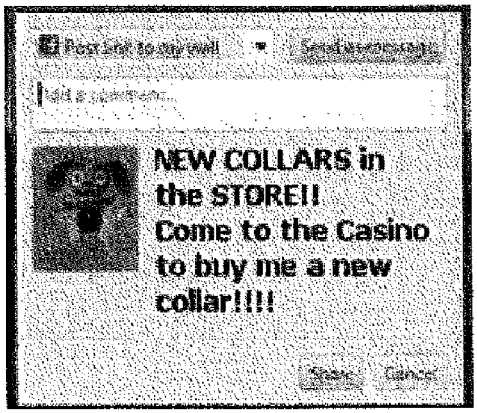

As stated above, as aspect of one or embodiments of the present invention is the ability to migrate the developed player loyalty over various media such as social media. FIG. 16 illustrates examples of social messages which may be sent by the enterprise to the player as a promotion to induce the player to return to the casino and receive virtual currency "Critter Cash" or to promote new accessories available for acquisition. The enterprise may send these messages to the player through media such as emails, Facebook, Twitter or the like.

In an embodiment users/players are able to buy/sell/transfer virtual objects inter se. The transactions may be unrestricted subject to reconciliation at one or more of the feature server 900 or player tracking server 837, slot accounting server 845 and/or player history database 357. The enterprise may impose restrictions on transfers such as any transaction is subject to a fee (paid with currency or currency equivalents and/or virtual cash or comps points), that one of the users/players be of a certain rating level (e.g. if there are rating tiers of Bronze (lowest), Silver and Gold only users/players of the Silver/Gold tiers may dispose or receive a transfer) or the users/players paying (currency or currency equivalents and/or virtual cash or comps points) to be enrolled in a subscription level. Another restriction which may be imposed is that only certain categories of virtual objects may be transferred such as objects which are no longer available for acquisition from the virtual store.

In regards to the virtual objects, in an embodiment, the virtual store may be configured to offer certain objects on a "limited edition" basis. For example, a virtual, luxurious pet bed or a prize bull for a virtual ranch may only be offered at the virtual store at certain times and/or be of a limited quantity. The enterprise issues messages to the users/players to inform them of the limited nature or acquisition periods. By designating a virtual object as a "limited edition" would foster frenzy or rush by players to try to acquire the limited edition feature, for their own collection or perhaps to sell to or trade with another user/player. A virtual registry may be established by the enterprise to list current and prior limited edition virtual objects and/or messages or a newsletter may issued periodically to inform the users/players about the rare or limited edition objects. In this regard certain objects may be subject to expiration and retirement. That is, for a designated virtual object such as a corn field for a virtual farm, in the fall of the year this object will expire and be removed from the user's/player's accounts who had previously acquired the same. The expiration is somewhat like the attributes of heath, happiness, youth which are subject to change over time. Further, as stated above, certain objects may evolve over time such as mature from a puppy to an adult dog or a beginner musician to an accomplished artist or the like through acquisition of virtual lessons. The evolution may be a feature which can be acquired though trade or purchase.

As stated herein, virtual objects may be awarded by the enterprise based upon results from a random number generator, drawing or lottery. For example, a random number generator (RNG) may select from a set of outcomes, each outcome relating to either an award of a virtual feature or a non-award. The outcomes may be weighted such that the random award of a certain feature is more or less likely than others. Periodically or based upon events such as when a player inserts their player loyalty card, the winning of a jackpot over a certain amount, total wagers in a casino network or purchases at a retail store reaching a trigger amount or other predetermined or random trigger event, the RNG, drawing or lottery is conducted for one, some or all of the users/players and the awards of any virtual objects is made. As a non-limiting example in a casino enterprise environment, when a player inserts their player loyalty card into the card reader and the player is recognized by the system, the RNG, drawing or lottery is conducted for the player and the player is either awarded or not awarded a virtual object. As stated above certain virtual objects may have a remote chance of being awarded and hence become more rare or limited. This feature acts as a "surprise" award of a virtual object.

In an embodiment the establishment arranges a "quest" for earning certain virtual objects. In a casino enterprise a quest is established to play certain games X, Y and Z at the venue or remotely within a twelve hour period. Earning the virtual object by completed the quest may entitle the player to participate in a drawing to win a car.

In an embodiment a casino enterprise may link the acquisition of one or more certain objects to an entitlement with respect to one or more primary games. As a non-limiting example, a player acquiring a virtual dog house for the pet may unlock a feature of certain primary games such as a secondary game, different pay table for the primary game, free spins or the like.

Figure 27:
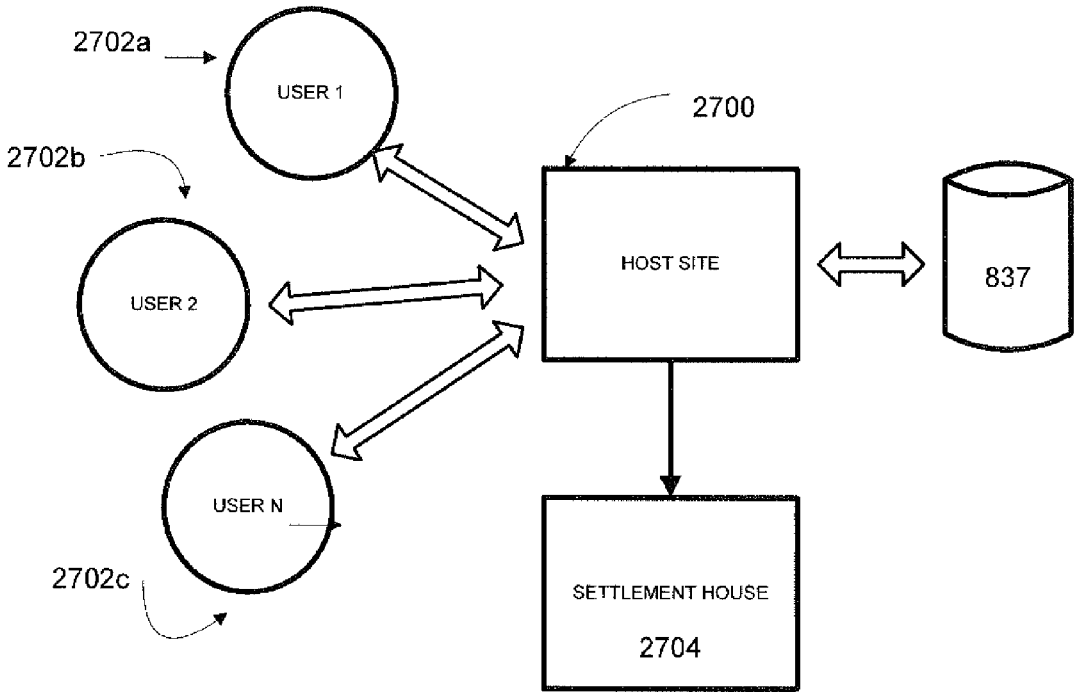
FIG. 27 illustrates a buy, sell or auction feature to sell or acquire virtual objects, accessories or accoutrements as between the users/players and hosted by or for the enterprise.

Turning to FIG. 27 an embodiment is shown where the enterprise, a third party or a third party on behalf of an enterprise hosts an auction site for the buying and selling of virtual object features/accessories/accoutrements. A host site 2700 is established, in this example by a casino enterprise, is established. The host site 2700 may be represented by an auction server and database. The host site 2700 is in communication with the feature server 900 or player tracking server 837, slot accounting server 845 and/or player history database 357 shown as player history database 357 for purposes of illustration. The player history database 357 stores for each player data including this virtual object and the acquired attributes/accessories/accoutrements. The host site 2700 and its database includes a data structure storing data representing the virtual attributes/accessories/accoutrements for sale or trade and the player offering the attributes/accessories/accoutrements for sale or trade. The host site 2700 may be fashioned akin to EBAY, QBI DS or the like. Each users 2702*a,b,c* establishes communication with the host site 2700 to either post their attributes/accessories/accoutrements for sale or trade or a proposal to acquire a certain attributes/accessories/accoutrements. When a user 2702*a* sells a virtual object to user 2702*b* a virtual settlement house 2704 settles the transaction and the host site 2700 reconciles the transfer by reconfiguring the users' accounts at the player history database, e.g. removing the feature from user 2702*a*'s account and adding the feature to user 2702*b*'s account. In this embodiment the enterprise operating the site may extract a fee from either the "seller", "buyer" or both. This feature enables users/players to transfer virtual attributes/accessories/accoutrements inter se.

Progressive Jackpot Game

According to a further aspect of the present invention, virtual object acquisitions may be used to qualify a user/player for a feature such as, for a casino enterprise, to play for one or more progressive jackpots. For a non-casino enterprise the feature may be a drawing for a promotional prize such as a new car or television. While the following description is directed to a casino enterprise and progressive games, it should be understood that the concepts and feature could well be used by other enterprises such as department or grocery stores, airlines, car rental companies or the like.

According to an embodiment of the invention the adoption or acquisition of one or more virtual objects and/or associated accessories is configured to determine qualification for a user/player in the feature such as, for a casino, participation in a mystery progressive game. This feature may be used in addition to the virtual pet features described above or as a separate feature. That is, the virtual pet and the acquisition of accessories as described above may be operated in parallel to the mystery progressive game.

Figure 17:
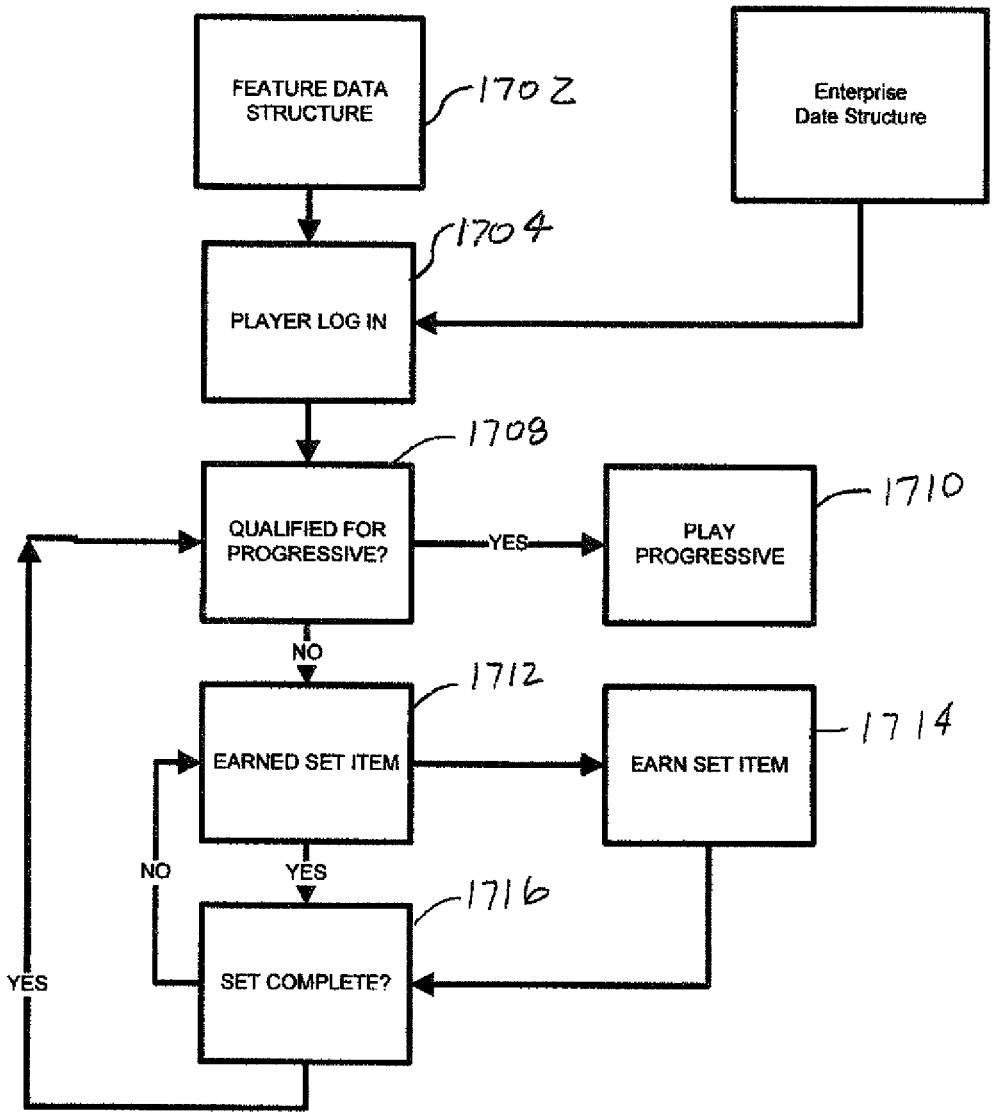
FIG. 17 is a logic diagram related to providing a progressive jackpot feature and the completion of a virtual object set for eligibility.
Figure 18:
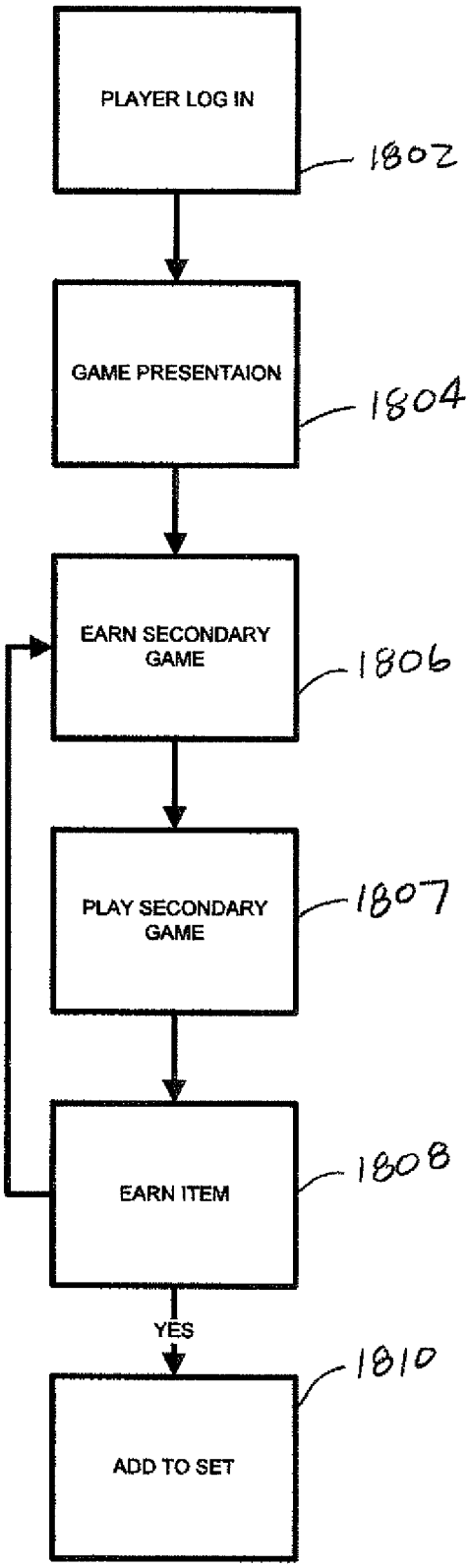
FIG. 18 is a logic diagram related to the play of the secondary game to earn a virtual object.
Figure 19:
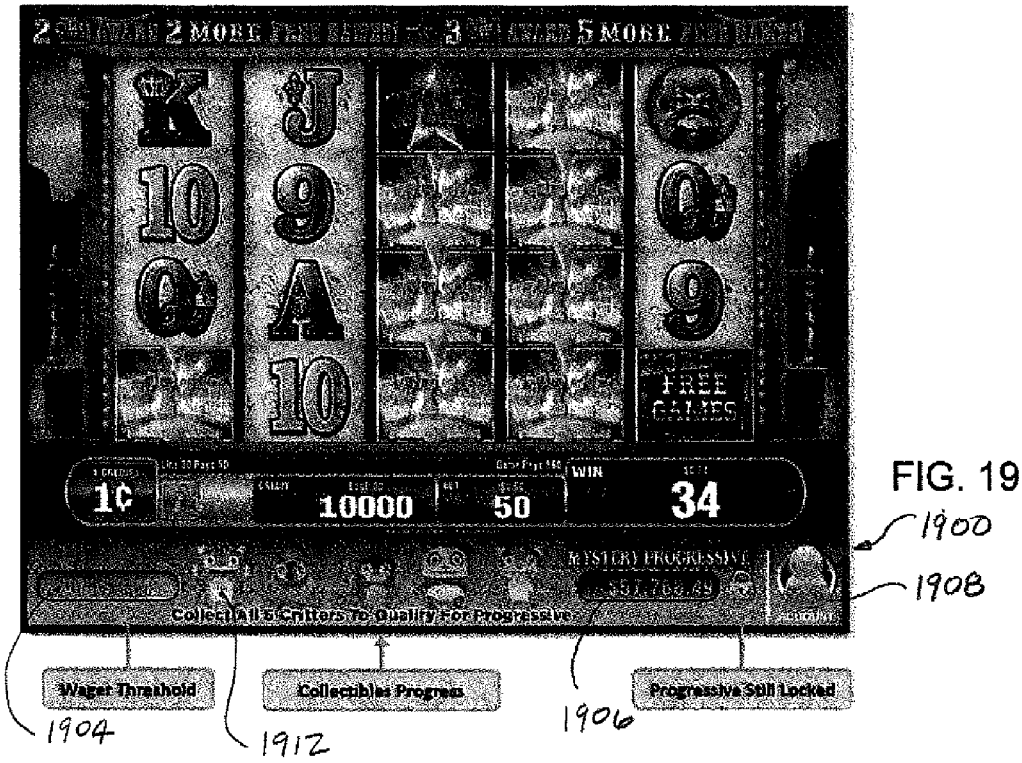
FIG. 19 shows a gaming device display indicating progression toward the play of a secondary, free game and the progress of collection of virtual object animals toward unlocking the progressive.
Figure 20:
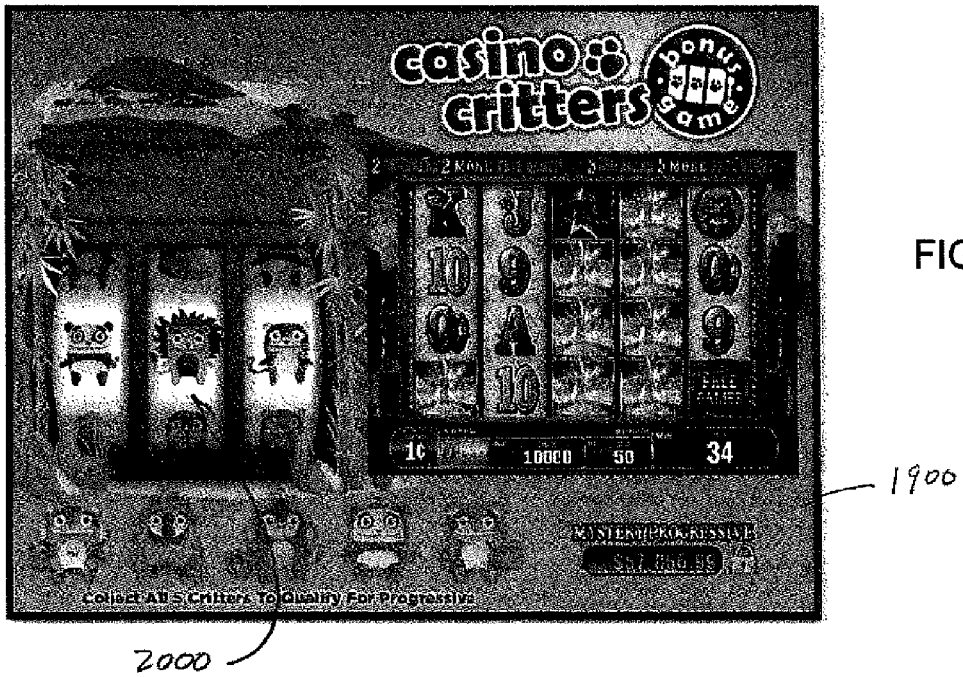
FIG. 20 illustrates a gaming machine display with the primary pay to play, base game and the free secondary game.

Turning to FIG. 17 an embodiment of the invention is described. According to this embodiment, for a player to be qualified to participate in a feature of a mystery progressive prize, the player must acquire, through commerce or intercourse with the casino enterprise, a set of virtual objects such as virtual animals or must assemble a complete virtual object. At 1702 the feature data structure (such as maintained at feature server 500 and/or virtual object server 900 and VOL library 1202 includes representations of the virtual animals and, if desired, associated animation packages. When the feature is installed the operator may select the nature of the virtual objects, e.g. animals, cars, people, personal property items, and the rules regarding collection and qualification. As described above the feature server 500 may interface with the player tracking server 837, slot accounting server 845 and/or player history database 357. At 1704 the player logs in to open access to their account (or to establish an account). The player may log in, for example, to the casino enterprise web-based site or may log in at a gaming device or kiosk as by inserting their player loyalty card into the card reader 32. Log in may require the player input a PIN. At login through the feature server 500 or via, for example, a cloud service 514 access is made available to the enterprise system data structures and servers and virtual object server 900 and VOL library 1202 shown collectively at 1706 required to support the functionality. Based upon the rules for qualification and the history of the collection of the virtual objects at 1708 a determination is made by, for example, the configured feature server 500 whether the player has qualified for the mystery progressive feature. If he/she has qualified at 1710 they are entitled to participate in the mystery progressive as described below. If the player has not yet qualified the feature server 500 alone or in conjunction with the slot accounting server 845 and/or player history database 357 at 1712 continues to query whether the player's activities to determine if the player has earned or been awarded a set item such as a virtual animal. If a virtual animal has been earned or awarded this event is recorded by at least the feature server at 1714. The status of the earned/awarded set may also be stored in one or more the enterprise servers/data structures. Upon earning or being awarded a virtual animal at 1714 the feature server determines at 1716, according to the established rules for qualification, if the required set has been acquired. If not the player continues to attempt to achieve the set at 1712, 1714. If the set has been completed at 1716 and the player has qualified to participate in the mystery progressive feature, as described below, at 1708 the player in informed of qualification and at 1710 he/she is entitled to participate in the mystery progressive feature.

FIGS. 18-22 describe an embodiment of the invention showing acquisition of the virtual animals for the qualifying set. At 1802 the player logs in, for example, at a gaming terminal 10 by inserting their player loyalty card. The player inserts money to play the gaming terminal 10 as is known in the art. At 1804 the game kernel 300 controls the primary display 14 to display a primary game presentation shown in FIG. 19 as a five reel video slot machine game display. The game presentation may be any game provided by the casino enterprise. Continuing with FIG. 19, and as controlled by the feature server 500, there is shown at a portion of the display a panel 1900 showing the set of virtual animals required for eligibility and indicating to the player that they have, in the past, earned/won a first virtual animal 1902 shown as a fanciful Tiger. The animals remaining for the player to collect for eligibility are the Parrot, Monkey, Panda and Leopard. Also displayed in the panel 1900 is a graphic scale 1904 showing the player's progress toward earning a free game during which the player can win a virtual animal. Opposite the scale there is shown a progressive meter 1906 showing the current value of the mystery progressive jackpot. An account icon 1908 provides a touch input button by which the player may call-up their casino account which may show current comp points, current virtual currency, data reflecting the virtual animals awarded toward eligibility, promotional offers, progressive eligibility and the like.

Figure 21:
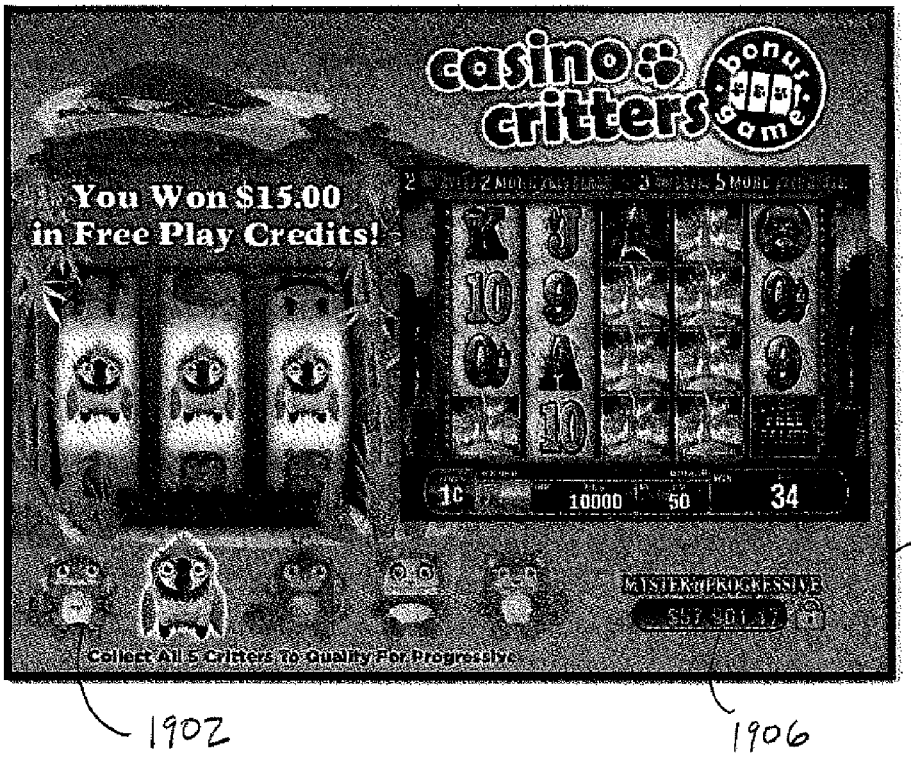
FIG. 21 illustrates a gaming machine display with base game and a secondary game winning outcome resulting in the collection of a virtual object.

At 1806 (FIG. 18) the player earns or is awarded the free play of a secondary game through which he/she can win a virtual animal. The free game may be awarded based upon several criteria, alone or in combination. For example, the second game may be earned though playing X bought base games, reaching an amount wagered on the play(s) of the primary game, obtaining base game outcome(s) such winning over a certain amount, consecutive losses of the base game, registering credits at the game, inserting a player loyalty card, events such as the enterprise issuing a free second game to the player, redemption of comps, a voucher or coupon, a jackpot won by another player or the like. When the free game has been awarded the scale 1904 indicates the award and may post a message inviting the player to touch the scale 1904 to play the free secondary game. In an embodiment the player may "bank" the free secondary game for later play and begin to earn another. The banked free game is recorded in one or more of the feature server 500 player tracking server 837 or at an appropriate database and is associated with the player account. Alternatively and additionally a ticket could be printed by the ticket printer 24 including a machine readable element such as a bar code representing the entitlement to the free secondary game. One or more free secondary games may be awarded for an event of the type described above At FIG. 20 there is illustrated an example of the display when a free secondary game has been awarded (or is being redeemed or played). The display of the base, P2P primary game of FIG. 19 may be sized to provide room for the secondary free game 2000 shown as a video, three-reel slot machine having symbols representing the virtual animals of the set. The feature server 500 may stream the secondary game video to the display, may select randomly or pseudo-randomly the outcome and send a signal to the GMU 207 and/or PID 209 which are configured to generate displays for the free secondary game 2000. As but an example, upon initiation of the play of a free secondary game at 1807 the feature server 500 may select the result for the free game 2000, e.g. a three Parrot outcome as shown in FIG. 21. The feature server 500 may then stream the outcome to the gaming device display 14 or may send a signal to a local processor such as the GMU 207 and/or PID which, in turn, control the display to display the determined outcome. It should be noted that where there is no apparatus or method for displaying the free secondary game 2000 at the primary game display 14, the results may be displayed at the PTM 28 display 30 (FIG. 1) or at the secondary display 18. Continuing with FIG. 20 the tally of virtual animals toward the set and those yet to be acquired are displayed at the panel 1900.

The secondary free game may be operated as a Class III or Class II type of game as defined by Title 25, United States Code §2701 et seq. and as is well known in the art. For example, a data set representing a universe of outcomes, for example, five thousand award and non-awarding outcomes may be randomly selected and associated with each player. For each free secondary game 2000 played and outcome is selected for display. The data set would have the desired population of winning outcomes for each virtual animal thus assuring that the player would fill out the required set within a maximum number of secondary games 2000.

FIG. 21 shows a free secondary game 2000 winning outcome awarding the virtual Parrot. The panel 1900 highlights the award of the Parrot.

After the play or presentation of each free secondary game 2000 the feature server 500 determines at 1808 if a virtual animal has been awarded. If so, at 1810 the virtual animal awarded is added to the set. As described above with respect to FIG. 17, if the set is complete at 1716 the player is now qualified for play of the progressive at 1710.

As stated above the free secondary game 2000 is configured for the player to acquire outcomes such as the awarding of a virtual animal of the required set. The required set may be represented by a virtual race car where the player must complete the car from virtual parts to become qualified, a virtual scuba diver who must be fully equipped or a virtual farm which must be completed with the acquisition of virtual livestock. The set may also be configured to reflect the theme of the enterprise or a seasonal theme, e.g. a spring season theme.

As described above the user/player when not at the enterprise such as the casino may access and view the current tally of the set of virtual objects. The enterprise may provide offers and promotions such as offering one virtual animal if the player visits the casino on a certain day at a certain time. To obtain their virtual animal the player must swipe their loyalty card at a gaming device 10 or casino kiosk. In this way the casino can entice the player to return where they may engage in gaming or other commercial activity.

Once the player has obtained the required virtual items they are qualified for the mystery progressive. The mystery progressive pool may be funded with marketing dollars (from the casino enterprise profits), third party funds and/or contributions from wagers on the primary game made by participating players. In an embodiment the pool is initially funded (seeded) with marketing dollars and thereafter contributions from the players funds the progressive growth of the pool as well as the amount for re-seeding the next jackpot pool. In another embodiment the progressive jackpot may be or include a static jackpot component representing a fixed amount or item such as a new car. For a fixed amount pool the seed amount may come from marketing dollars. The progressive jackpot may be a combination of a progressive pool of money plus an item like a new car. Thus it should be understood that "progressive jackpot" as used herein includes static as well as jackpots which grow through contributions.

The progressive meter 1906 displays the current value of the jackpot. The trigger for the award of the jackpot may be based upon a random or predetermined event. Examples of mystery triggers for progressive jackpots include: a coin in trigger which triggers the jackpot to at least the player whose contribution to the progressive pool caused the pool to achieve a randomly or pseudo-randomly selected value X, a "games played" trigger paid to the qualified player who has played the randomly/pseudo-randomly selected $Y^{th}$ primary game since the pool initiated, a coin out trigger to the player who was paid on their base game sufficient to cause the aggregate amount paid out to qualified players (Σcoin out) to meet or exceed a randomly/pseudo-randomly selected aggregate coin out amount, the player winning a hidden lottery or pseudo-lottery or drawing, the qualified player who next plays a paid for base game when randomly/pseudo-randomly selected time since the first player qualified or after Z players have qualified or the like. In an embodiment where the trigger is a hidden drawing, at random or predetermine time "slices" and as described in Kelly et al, U.S. Pat. No. 8,353,761 titled "Progressive Game and Processing System Thereof" which is assigned to the assignee of the present invention and the disclosure of which is incorporated by reference a hidden drawing of one or more numbers is selected from, for example, a number pool of the numbers 1-N where "1" is determined to the trigger number. At each time slice draw the drawn number(s) are compared to the number "1" and if there is no match the drawn numbers may be deducted from the number pool. Thus the odds increase toward a winning draw with each draw. If in a draw the trigger number of "1" is selected, the award is triggered. The feature server 500 determines the gaming devices 10 on the network where (a) the player is qualified, i.e. has completed their set of virtual animals and (b) their P2P history qualifies the gaming device 10. P2P history qualification can be, for example, a maximum bet in the previous primary game play and at least five primary game plays (including the play of any feature game) within the past minute. Other qualifications can be adopted. For the group of qualified devices being played by qualified players, the feature server 500 randomly selects one or more gaming devices 10 to which the jackpot will be awarded. Other triggers may an award of all or a portion of the jackpot at a time certain to a qualified gaming device 10 being played by a qualified player. Another trigger may be the lottery style where, based upon the player's primary game wager, they receive numbers in a virtual lottery. For example, if Player A wagers 1 credit they have the number "1" and where Player B wagers 10 units they have the numbers "1-10". With each primary game play a winning number is selected from a set of lottery numbers 1-L where, for example, L=1-10,000,000. If a qualifying player's number is selected they are awarded all or a portion of the jackpot pool. This provides the incentive to wager a maximum amount at least after qualification. Further machines of different denominations may use the same trigger while providing the same incentive by defining the unit as the smallest denomination credit on the network. By way of example, if the smallest denomination gaming device 10 on the network is a 1¢ denomination game, then the player would have a number for the equivalent of each 1¢ wagered, e.g. a wager of $1.25 would provide the player with the numbers 1-125 in the lottery. This scheme is like that disclosed in Olive, U.S. Pat. No. 7,582,014 described above and incorporated by reference. In a variation the scheme described in Torango, U.S. Pat. No. 6,592,460 also described above and incorporated by reference could be used as a trigger (rather than providing a range of numbers, the player has the number "1" and the set of numbers 1-L is proportionately reduced based upon the magnitude of the wager.

In an embodiment the jackpot (progressive or static) may be a symbol based jackpot. For example, gaming machines 10 with like award structures could be liked at the system level to provide the jackpot to a qualified player obtaining, for example, the top prize award for the game.

Figure 22:
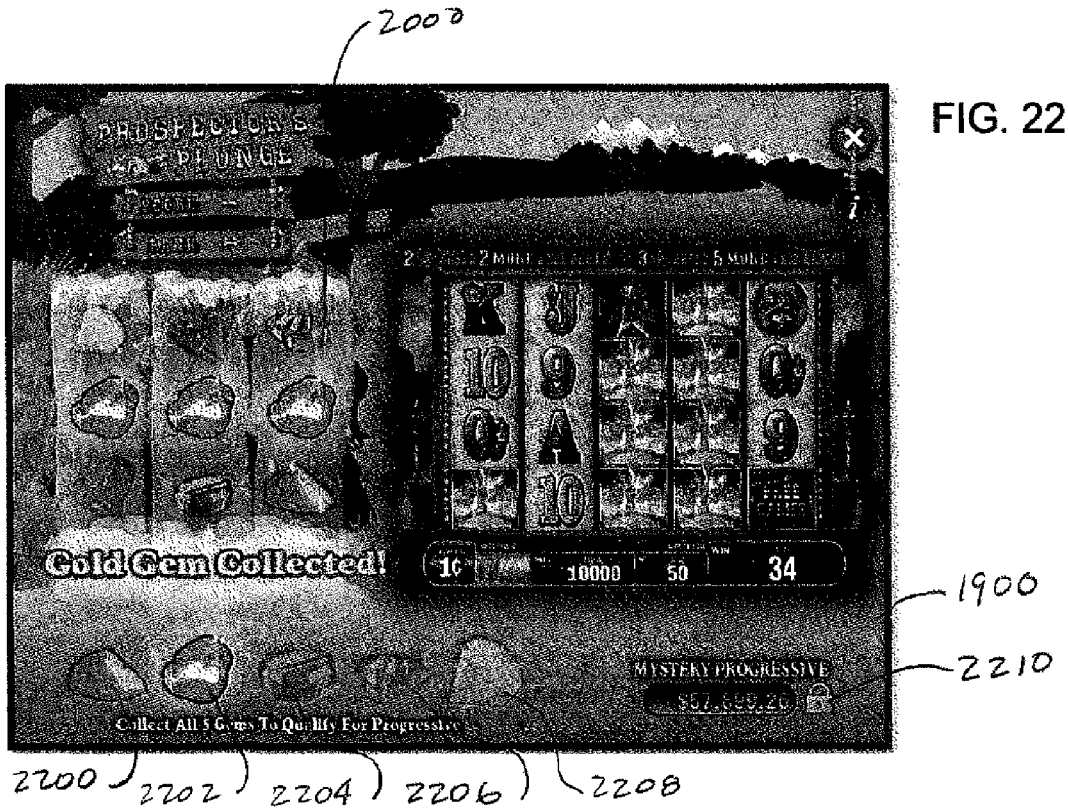
FIG. 22 illustrates a gaming machine display showing collection of different virtual objects.
Figure 24:
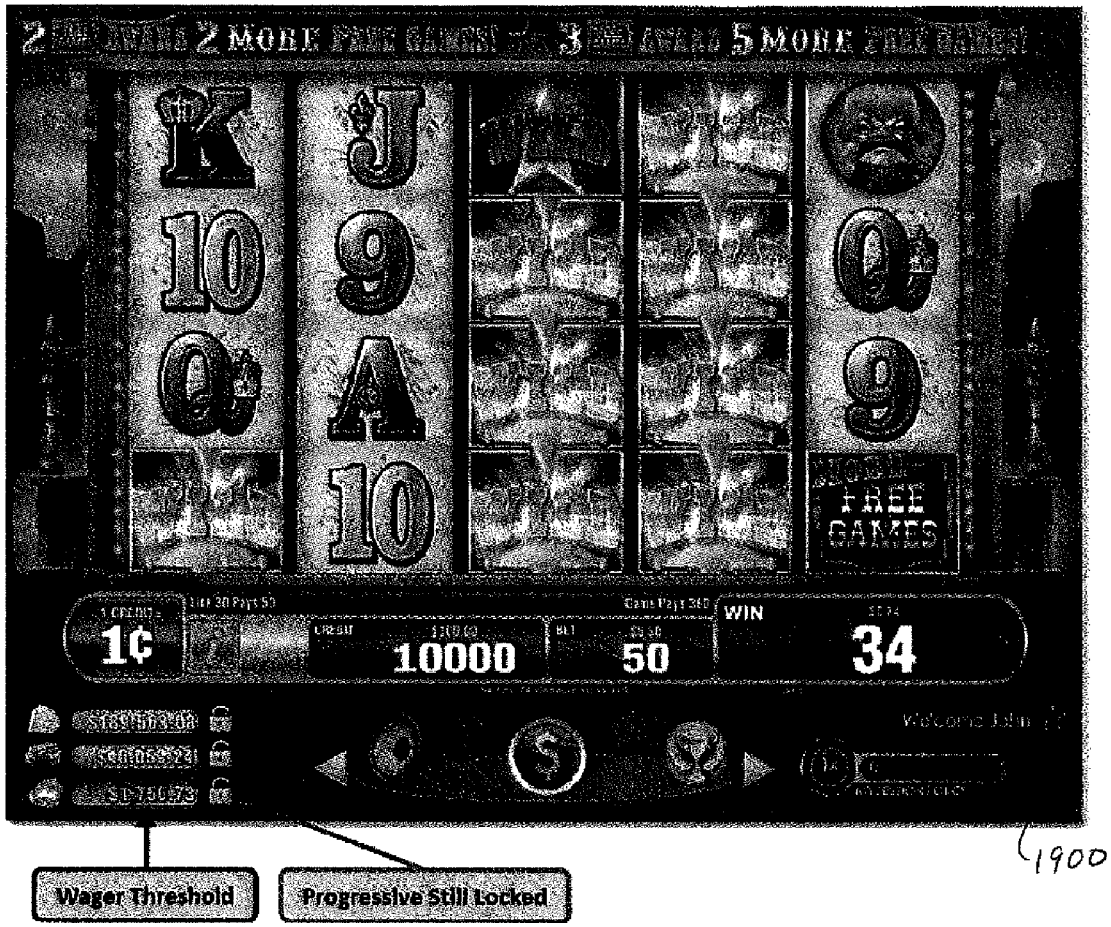
FIG. 24 illustrates a gaming device display where the player seeks eligibility in one or more progressive jackpot games.
Figure 25:
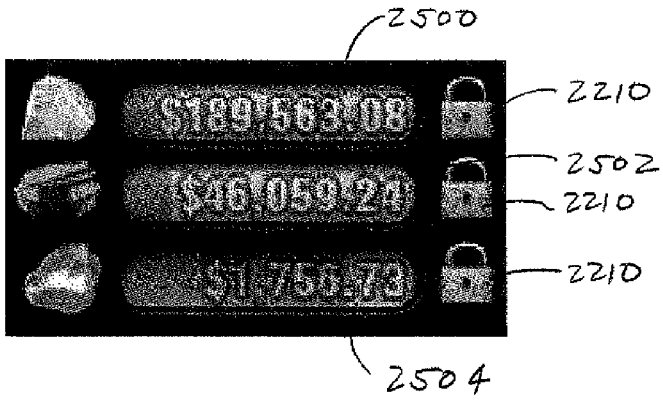
FIG. 25 is an enlarged view of the table of FIG. 24 showing the players progress toward eligibility.

More than one jackpot may be offered as suggested in FIGS. 22 and 24 and 25. For example, the set of virtual objects may consist of, by way of example, five different Gems shown at panel 1900 in FIG. 22 as: a silver Gem 2200, a Gold Gem 2202, a Ruby 2204, an Emerald 2206 and a Diamond 2208. The secondary game 2000 is illustrated in this embodiment to have a waterfall theme. As described, in an embodiment, it may be necessary for the player, through play of the secondary game, to acquire all five Gems to be qualified for the single progressive prize or other jackpot such as a physical object like a car. The progressive meter 1906 is shown in FIG. 22 as well as a locked icon 2210 indicating that the player has yet to qualify and hence the progressive prize is "locked" to the player. In an alternate embodiment as shown in FIGS. 24 and 25 multiple mystery progressive jackpots (or other jackpots as described above) may be provided and are unlocked with the acquisition of one or more virtual objects. For example three progressive mystery jackpots 2500, 2502 and 2504 are provided with the player qualifying for the jackpot 2500 (the larger jackpot shown as $189,563.08) when the player has acquired the Diamond virtual object as by having the secondary game 2000 randomly produce an outcome of three Diamonds on a designated pay line, for example a single provided pay line, scatter or on one of multiple pay lines. The player qualifies for jackpot 2502 when he/she acquires the Ruby object as by having a three Ruby outcome in the secondary game. The player qualifies for the jackpot 2504 when he/she has a winning, three Gold Gem, outcome, at the secondary game. As shown, the locked icon 2210 shows that player that they have yet to qualify for any jackpot. The jackpots may be mixed as between moneyed progressive prizes or physical things such as cars or other prizes. Thus it should be understood that as the player plays earned, awarded or provided secondary games as described above they obtain outcomes to award Gems and thus qualify for one or more of the jackpots. If, for example, the player has collected all three of the Diamond, Ruby and Gold Gem they would qualify for all jackpot prizes. The locked icons 2210 would be shown in an unlocked condition to indicate player qualification. Each progressive prize may be awarded based upon a trigger as described above. The progressive jackpots may have different triggers.

Figure 23:
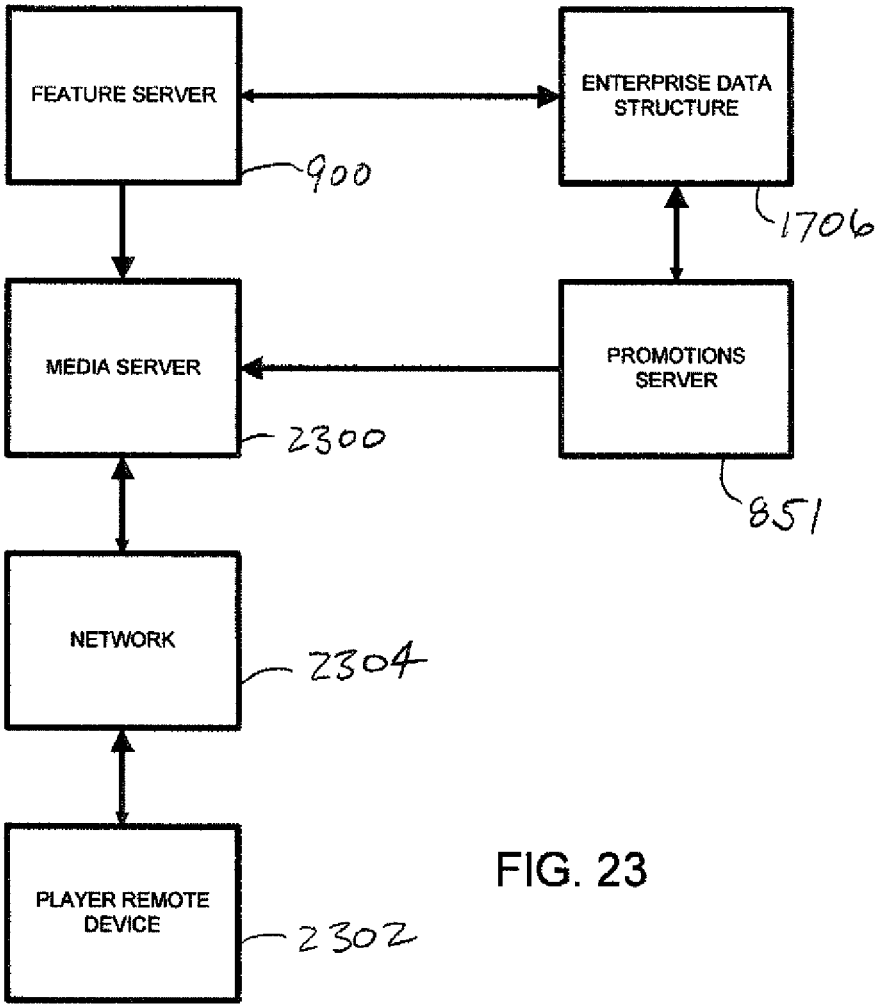
FIG. 23 is a logic diagram illustrating the provision of promotions to various remote media devices.
Figure 26:
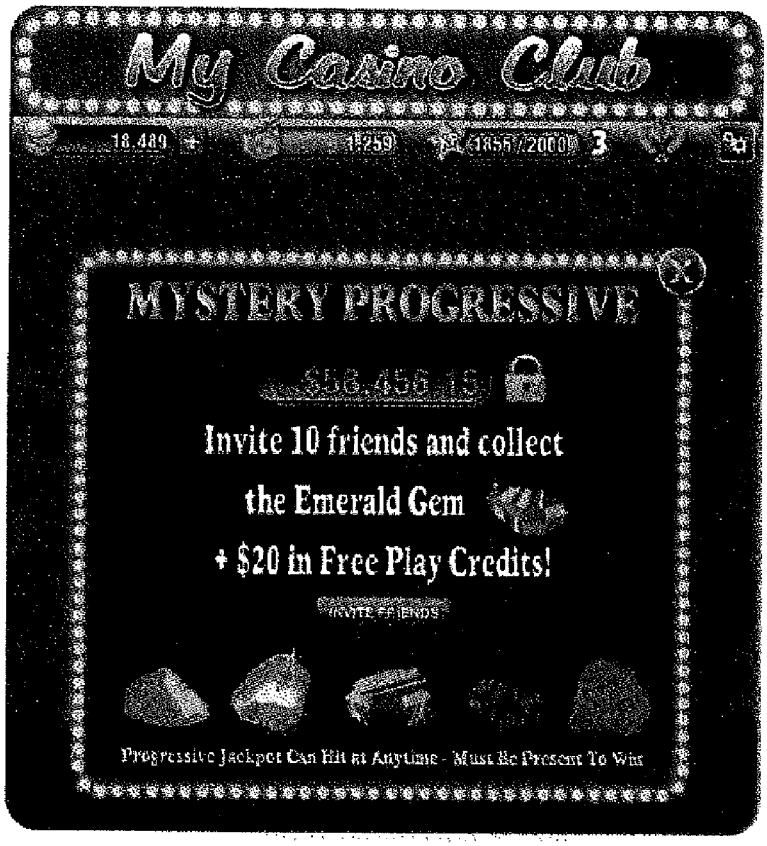
FIG. 26 shows illustrates displays on remote devices related to the progressive jackpot features of the present invention.
Figure 26:
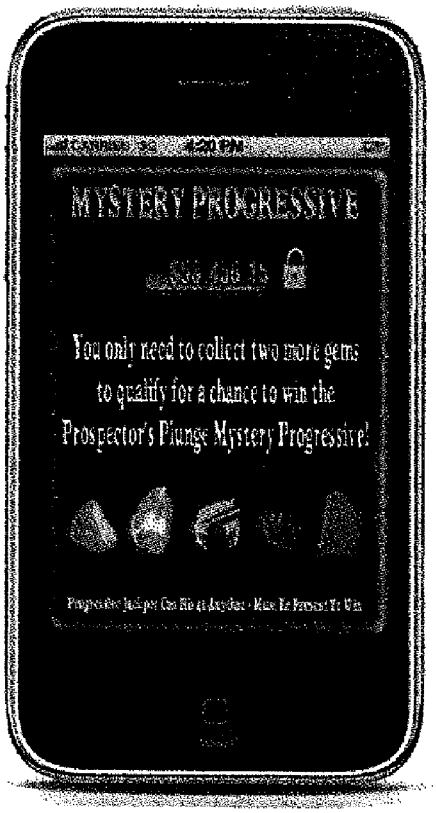

FIG. 23 illustrates remote access to features of the present invention. An enterprise data structure 1706 is in communication with a promo control server 851 and feature server 900. These servers and associated data structures provide access to the players' accounts, promotional offerings and associated graphics as well the feature server operating the virtual object and/or related progressive operations. A media server 2300 and associated data structure is configured, alone or in combination with other servers, software and data structures, for the packaging of delivery of content associated with the various inventions as described herein. For example, a player from a remote device 2300 such as a cellular telephone may, though a previously downloaded software application, access the provider's site and seek to see current promotional offers as well as their virtual animal pet and/or the status of any qualification for a jackpot as described above. This request is passed through the communication network 2304 (broadband/Internet) to the media server 2300. The content may be delivered through social network sites or via direct connection. The media server 2300 delivers to the player graphics, interfaces, video, audio, etc. configured for the player's device for display and sounds. Upon entering or responding to a prompt for security access, e.g. entering the player's PIN, the feature server 500 pulls together the player's account information which is provide to the media server 2300 for configuration and transmission through the network 2304 to the player's remote device 2302. FIG. 26 shows several views which may appear on the player's device. The displays may include promotional offers such as in a social media context "Invite 10 friends and collect the Emerald Gem+$20 in Free Play Credits". In this offer the free play credits are for $20 worth of play of the primary, P2P game. Other offers may include plays of the secondary games, discounted redemption of comp credits used to purchase secondary games or the like.

The media server 2300 may also control the player's device to display the status of the collection of the Gems.

The foregoing description focused upon implementations and embodiments related to a casino enterprise. It should be understood that the inventions described herein can be utilized by other brick and mortar enterprises such as department store chains, grocery store chains, convenience stores, gasoline stations and the like. Further several aspects are applicable to Internet based enterprises.

The foregoing description, for purposes of explanation, uses specific nomenclature and formula to provide a thorough understanding of the invention. It should be apparent to those of skill in the art that the specific details are not required in order to practice the invention. The embodiments have been chosen and described to best explain the principles of the invention and its practical application, thereby enabling others of skill in the art to utilize the invention, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

What is claimed is:

1. An improved system for an enterprise of the type having at least one physical venue including at least one commercial transaction terminal accessing a video display, a host server for tracking a user's interaction with said terminals, a communication network and a data structure storing a data file for each user, said improvement comprising:

a data resource storing data corresponding to at least one (i) graphical virtual object, and (ii) graphic display packages associated with said object, one or more of said data resource and user's file storing data associating a virtual object with a user;

apparatus to enable a user to remotely access the data in their associated file via a portable device and view their virtual object data at said remote interface device display;

software controlling a feature server in communication with said one or more of said data resource and user's file, one of said feature server and host server configured to display said virtual object at a user terminal display;

one or more of said host and feature server configured to store data representing virtual currency awarded to the user; and said feature server configured to enable said user to redeem virtual currency to alter the data corresponding to the user's virtual object by at least one acquisition a virtual object, acquisition an attribute assigned to a virtual object and acquisition a virtual accessory for a virtual object.

2. The system of claim 1 comprising said feature server configured to accept redemption of virtual currency to alter the virtual object data at each of said at least one terminal at said enterprise venue and via said remote interface device.

3. The system of claim 1 comprising said feature server configured to accept redemption of virtual currency to at least one of acquisition of the virtual object, attribute or accessory at said at least one terminal.

4. The system of claim 3 comprising one or more of said host and feature server configured to store data representing at least two classes of virtual currency awarded to the user, a first class redeemable for selected virtual objects, attributes or accessories at said one or more terminals and a second class redeemable for selected virtual objects, attributes or accessories at said remote interface device.

5. The system of claim 1 comprising said feature server configured to diminish an acquired attribute over time.

6. The system of claim 5 comprising said feature server configured to enable a user to redeem virtual currency to restore a diminished attribute.

7. The system of claim 6 comprising one or more of said host and feature server configured to store data representing at least two classes of virtual currency awarded to the user said feature server configured for a user to redeem one class of virtual currency at one of said terminals at said venue to restore a diminished attribute.

8. The system of claim 3 comprising one or more of said host and feature server configured to award virtual currency of said first class to a user in exchange for commercial interaction with said enterprise.

9. The system of claim 3 comprising said feature server is configured to award virtual currency of said second class to a user at said remote interface device.

10. The system of claim 1 comprising said feature server is configured to award a virtual object to a user responsive to a predetermined event.

11. The system of claim 10 comprising said feature server is configured to award a virtual object in response to at least one of (i) a user's selection, (ii) acquisition through redemption of said virtual currency, (iii) a user's commercial transaction having a predetermined value and (iv) in response to one or more random events.

12. The system of claim 1 comprising said data resource stores data corresponding to a virtual pet.

13. The system of claim 12 comprising said data resource stores data corresponding to a plurality of attributes associated with the virtual pet including physical condition.

14. The system of claim 1 wherein said enterprise is a casino and said at least commercial transaction terminal is a gaming device, said system comprising one or more of said host and feature server configured to store data representing virtual currency awarded to the user in response to wagering activity at said gaming device.

15. The system of claim 1 comprising one or more of said host and feature server configured to award a benefit to a user in response to one or more of a user's acquisition of virtual object, acquisition an attribute assigned to a virtual object and acquisition a virtual accessory for a virtual object.

16. The system of claim 15 comprising one or more of said host and feature server configured to award a promotion to a user in response to one or more of a user's acquisition of virtual object, acquisition an attribute assigned to a virtual object and acquisition a virtual accessory for a virtual object

17. The system of claim 1 comprising said data resource stores data corresponding to a virtual object as a virtual environment.

18. An improved method for an casino enterprise of the type having at least one physical casino venue including gaming terminals each having a video display, a host server for tracking a player's play said terminals, a communication network and a data structure storing a data file for each player, said method comprising:

storing at a data resource data corresponding to a (i) virtual object, (ii) a plurality of attributes associated with the virtual object, and (iii) graphics associated with said object and attributes, one or more of said data resource and player's file storing data associating a virtual object and its current attributes with a player;

enabling a player to remotely access the data in their associated file and view their virtual object and current attributes at a remote device display;

programming with software a feature server in communication with said one or more of said data resource and a player's data file for (i) displaying at terminal and remote device displays said player's virtual object, attributes and associated graphics, (ii) storing at one or more of said host and feature server virtual currency awarded to the player and (iii) enabling said player to redeem said virtual currency to restore or acquire said attributes.

19. The method of claim 18 comprising animating said virtual object in response to a predetermined event.

20. An improved system for a network of gaming devices each configured to accept a wager from a player for the play of a game which produces either a winning or losing outcome, a host server for tracking the player's play, a communication network and said host server and a data structure storing a data file for each player, said improvement comprising:

a data resource storing data corresponding to at least one graphical virtual object and data files associating any virtual object collected by a player with the player;

a feature server instructed by software for accessing and retrieving from said player data files data representing virtual objected collected by the player, said gaming devices configured for displaying to a player at a display the virtual objected collected by the player;

said feature server instructed by software to (i) defining one or more virtual objects collected by the player as a qualifying set, (ii) establish one or more trigger events for awarding a virtual object for collection by a player, collection of the virtual object(s) of a defined set qualifying the player to participate in a progressive jackpot game (iii) upon qualification of a player contributing a portion of the player's wager to the progressive jackpot and (iv) awarding at least a portion of the jackpot to a player upon the occurrence of a trigger event.

* * * * *